US007665705B2

(12) United States Patent
Wong

(10) Patent No.: US 7,665,705 B2
(45) Date of Patent: Feb. 23, 2010

(54) PICTURE FRAME POSITIONER

(76) Inventor: Hammond Wong, 2843 Trish Way, West Covina, CA (US) 92791

( * ) Notice: Subject to any disclaimer, the term of this patent is extended or adjusted under 35 U.S.C. 154(b) by 40 days.

(21) Appl. No.: 11/680,976

(22) Filed: Mar. 1, 2007

(65) Prior Publication Data

US 2007/0295880 A1 Dec. 27, 2007

Related U.S. Application Data

(63) Continuation-in-part of application No. 11/309,138, filed on Jun. 27, 2006.

(51) Int. Cl.
*A47G 1/16* (2006.01)
*A47G 1/24* (2006.01)

(52) U.S. Cl. ..... 248/489; 248/467; 248/476; 248/495

(58) Field of Classification Search ..... 248/467, 248/469, 470–471, 476, 489, 494–495, 317, 248/323, 333, 480, 205.3, 447.1, 447, 451; 24/8, 489, 490, 716; 211/103, 106.01, 113
See application file for complete search history.

(56) References Cited

U.S. PATENT DOCUMENTS

| | | | | | |
|---|---|---|---|---|---|
| 2,015,280 | A * | 9/1935 | Morishita | 248/451 |
| 2,492,411 | A | 12/1949 | Barnes et al. | 248/29 |
| 3,622,116 | A | 11/1971 | Fellows | 248/467 |
| 4,034,945 | A * | 7/1977 | Sato | 248/103 |
| 4,061,300 | A * | 12/1977 | Takahashi | 248/125.2 |
| 4,228,982 | A * | 10/1980 | Sellera | 248/467 |
| 4,336,884 | A | 6/1982 | Hart et al. | 206/575 |
| 4,384,648 | A | 5/1983 | Hart et al. | 206/527 |
| 5,342,014 | A * | 8/1994 | Wilson | 248/476 |
| 5,433,416 | A | 7/1995 | Johnson | 248/475.1 |
| 5,984,287 | A * | 11/1999 | Fitzsimmons | 269/17 |
| 6,095,465 | A | 8/2000 | Weck et al. | 248/205.3 |
| 6,286,803 | B1 * | 9/2001 | Pellino et al. | 248/490 |
| 6,484,993 | B2 * | 11/2002 | Huffman | 248/323 |
| 2004/0084598 | A1 | 5/2004 | Dodig | 248/475.1 |
| 2007/0075211 | A1 * | 4/2007 | Potter | 248/476 |
| 2007/0295880 | A1 * | 12/2007 | Wong | 248/495 |

* cited by examiner

*Primary Examiner*—Amy J. Sterling
*Assistant Examiner*—Tan Le
(74) *Attorney, Agent, or Firm*—Walter J. Tencza, Jr.

(57) ABSTRACT

An apparatus is provided including a main body portion, a first portion connected to the main body portion, and an extension portion connected to the first portion. The extension portion is comprised of an extension arm and a base. The base is configured to slide up and down the extension arm. The apparatus further includes a base engagement means, and a base release. The base engagement means does not allow the base to slide down the extension arm away from the first portion unless the base release has been activated. The base engagement means allows the base to slide up the extension arm toward the first portion regardless of whether the base release has been activated. The apparatus may be used to hang up a picture frame.

5 Claims, 29 Drawing Sheets

PICTURE FRAME POSITIONER

CROSS REFERENCE TO RELATED APPLICATION(S)

The present application is a continuation in part of and claims the priority of U.S. patent application Ser. No. 11/309,138, filed on Jun. 27, 2006, applicant and inventor Hammond Wong, titled "Picture Frame Positioner".

FIELD OF THE INVENTION

This invention relates to improved methods and apparatus concerning picture frames.

BACKGROUND OF THE INVENTION

Individuals usually guess or make a rough estimate about where picture frames need to be hung. In order to make it right, the most common way is to measure the distance from the top of a ceiling to a top of the picture frame, and then the distance from the left to the right of the wall, and then to mark down the center point where the frame is about to be hung. Even after an individual has found the center point, there are still difficulties for the individual to hang the particular picture frame the precisely to the place they want. To get more precise measurement, they need to: (a) match the center point that they mark down on the wall to the center point of the frame; (b) calculate the exact distance from the top of the wire at the back of the frame to the top of the frame; (c) know the design of the metal hanger, the measurement from the top of the hanger to the hook; and (d) know the tension of the wire. Usually nails are applied on the wall along with metal hangers. However, the nails may be removed and reapplied repeatedly on the wall if the position of the frame is incorrect, causing physical damage to the wall. It's a tedious and time consuming process which requires professional skill to handle.

There are various devices known in the prior art for hanging picture frames. U.S. Pat. No. 4,336,884 to Hart et. al. discloses a picture frame hanging backing sheet 10. (Hart et. al, FIG. 1). The sheet 10 includes adhesive areas 44 for releasably adhering to a picture frame and adhesive areas 48 for releasably adhering to a wall. (Hart et. al, FIGS. 1 and 2). Hangers 12 are inserted into slots in the backing sheet 10. (Id.) In operation, the adhesive areas 44 are adhered to the back of a picture frame (with the hangers 12 inserted into the sheet 10), such that a wire 52 at the back of the frame is hung over the hangers 12 and is slightly tensioned. (Hart et. al, FIGS. 1 2, 4a, col. 5, Ins. 1-10). Next the adhesive areas 48 are pressed against a wall, and adhered to the wall, causing the sheet 10 to be adhered to the wall. Next the picture frame is removed from the sheet 10, by releasing the adhesive areas 44 from the picture frame and by removing the wire 52 from the hangers 12. With the sheet 10 adhered to the wall by adhesive areas 48, and the hangers 12 inserted into the sheet 10, the hangers 12 are fixed to the wall by, for example, hammering nails into the hangers 12. (Hart et. al., FIG. 4b). Each of the hangers 12 has a single opening for a nail. (Hart et. al., FIG. 1). Next, the sheet 10 is removed from the hangers 12, leaving the hangers 12 nailed into the wall. (Hart et al., FIG. 4c). The picture frame can then be hung by draping the wire 52 over the hangers 12.

U.S. Pat. No. 6,095,465 to Weck et. al. discloses a picture hanger member 12 with a triangular shaped base 14 and an opening 20. (Weck et. al., FIG. 1, col. 4, Ins. 60-65). A temporary adhesive 46 is attached to a hanger member 12.

(Weck, FIG. 1). The hanger member 12 can be temporarily attached to a wall 34, by adhesive 46 and then moved if the hanger member 12 is not at the correct position. (Weck, col. 5, Ins. 48-60). The hanger member 12 includes three nail receiving guide holes 22 within three guides or protrusions 28. (Weck, FIG. 2). Nails can be driven through a shock absorbing layer 40 to fix the hanger member 12 to the wall 34. (Weck, col. 5 In. 48- col. 6, In. 56).

U.S. Pat. No. 3,622,116 to Fellows, discloses a tongue member 10 which is fixed to a picture frame 26 and then inserted into a bracket member 30 fixed to a supporting surface 32. (Fellows, FIGS. 1-8). U.S. Pat. No. 4,228,982 to Sellera discloses a wall pad 16 and a frame pad 22. (Sellera, col. 1, In. 50-col. 2, In. 30). The wall pad 16 and the frame pad 22 have adhesives which adhere to a wall and a back of a picture frame, respectively. (Id.). The frame pad 22 has a downward extension 82 which can be inserted into a pocket 53 of the wall pad 16 to hang a picture frame onto a wall. (Id.) U.S. Pat. No. 2,492,411 to Barnes provides a resilient member 29 which adheres to a wall and a picture frame to keep the frame straight. (Barnes, col. 2, In. 44-col. 3, In. 29). U.S. Patent Application No. US 2004/0084598 A1 to Dodig, J R. discloses a mounting carrier 22 having a pair of hooks 20. (Dodig, p 2, paragraph 19-paragraph 25). The carrier 22 is mounted on a wall 14 and thereafter a picture 12 is hung by a wire from 18 from the hooks 20. (Dodig, Id.).

SUMMARY OF THE INVENTION

One or more embodiments of the present invention provide a simple way to position and hang picture frames on a wall without professional skill. A picture frame can be aligned visually on a wall without precise measurements. A picture frame can be positioned and adjusted precisely before hardware is applied, eliminating unnecessary holes in walls.

The present invention in one embodiment provides an apparatus comprising a J-shaped hanger and a first device. The J-shaped hanger includes a hook and a base, the hook connected to the base, the base forming a substantially flat vertical portion of the J-shape, the hook forming the hook portion. The first device has a first portion having an opening which is large enough so that the base can pass through the opening of the first portion while the base is substantially parallel to the first device. The first device has a front with a first temporary or removable adhesive and a back with a second temporary or removable adhesive.

The base of the J-shaped hanger may include an opening. The first device may include a lower cap portion having a protrusion which can be inserted into the opening of the J-shaped hanger and which snaps into the opening of the base of the J-shaped hanger to hold the J-shaped hanger to the lower cap portion of the first device. The base of the J-shaped hanger may have attached thereto a plurality of protrusions each having an opening through which a nail can be driven.

The present invention in one embodiment includes a method comprised of pulling a wire of a picture frame up with a J-shaped hanger of an apparatus, and attaching the apparatus including the J-shaped hanger to a back of the picture frame, so that the wire is tensed. The apparatus may be configured as previously described. The method may further include detaching the J-shaped hanger from the rest of the apparatus, and attaching the second temporary adhesive to a wall to attach a first portion of the apparatus to the wall. The method may also include inserting the J-shaped hanger into the first portion of the apparatus and fastening the J-shaped hanger to the wall. In one embodiment any remaining portion of the apparatus may be detached from the wall, while leaving the J-shaped hanger fastened to the wall.

In another embodiment of the present invention, an apparatus is provided which includes a main body portion, a first portion connected to the main body portion, and an extension portion connected to the first portion. The extension portion is comprised of an extension arm and a base. The base is configured to slide up and down the extension arm. The first portion may be connected to the main body portion so that the main body portion pivots with respect to the first portion. A clamp may be connected to the main body portion so that the clamp can pivot with respect to the main body portion, and a handle may be connected to the clamp so that the handle can pivot with respect to the clamp.

The main body portion may be comprised of a top surface and a bottom surface. The apparatus may be further comprised of a button on the top surface of the main body portion, which can be slid in order to slide the clamp and the handle. A base release may also be provided which releases the base and allows the base to slide up and down the extension arm. The extension arm can be configured so that it can move outwards in order to lengthen the extension portion. In one embodiment of the present invention the apparatus, including the main body portion, the first portion, and the extension portion, can be used to hang a picture up.

DETAILED DESCRIPTION OF THE DRAWINGS

Figure 1:
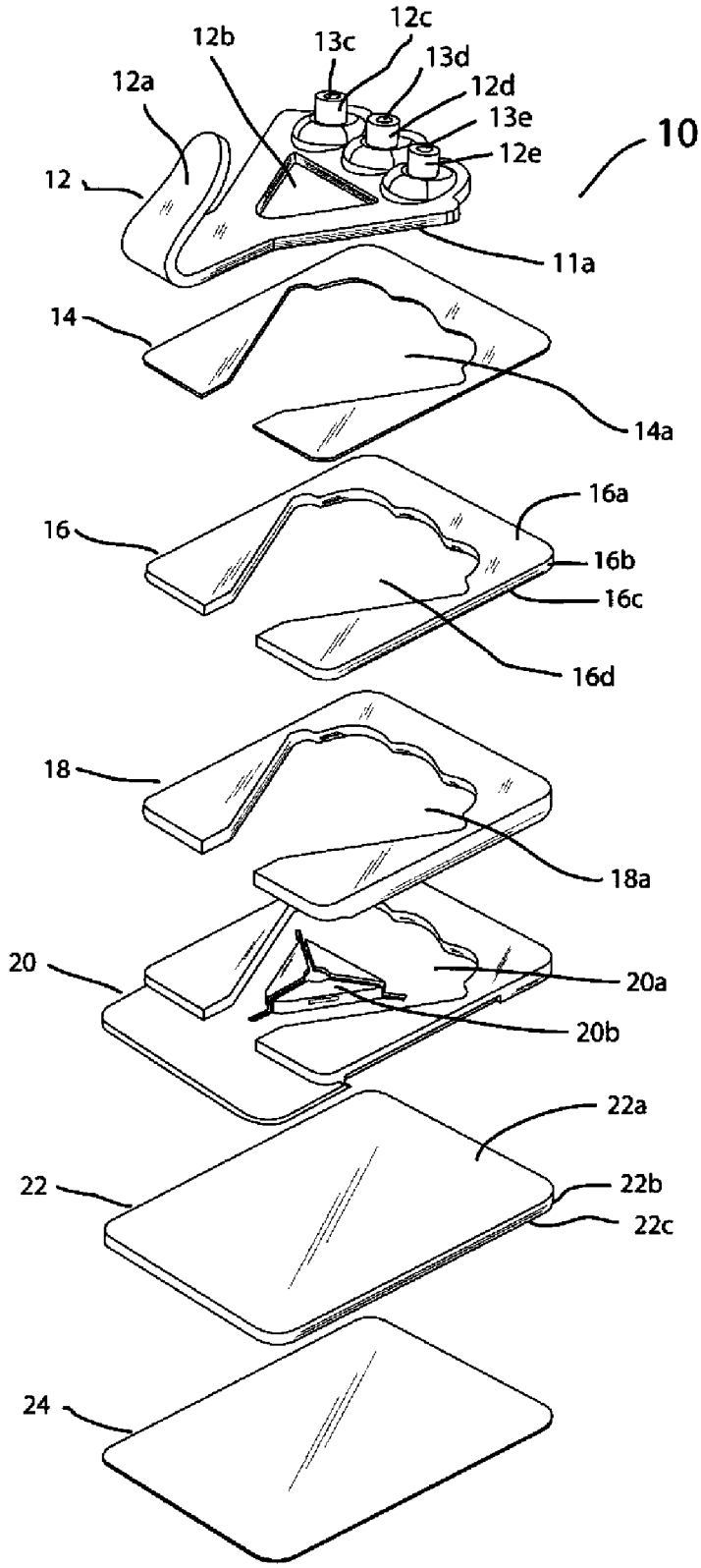
FIG. 1 shows a perspective view of an apparatus or positioner in accordance with an embodiment of the present invention with the apparatus shown taken apart.
Figure 2A:
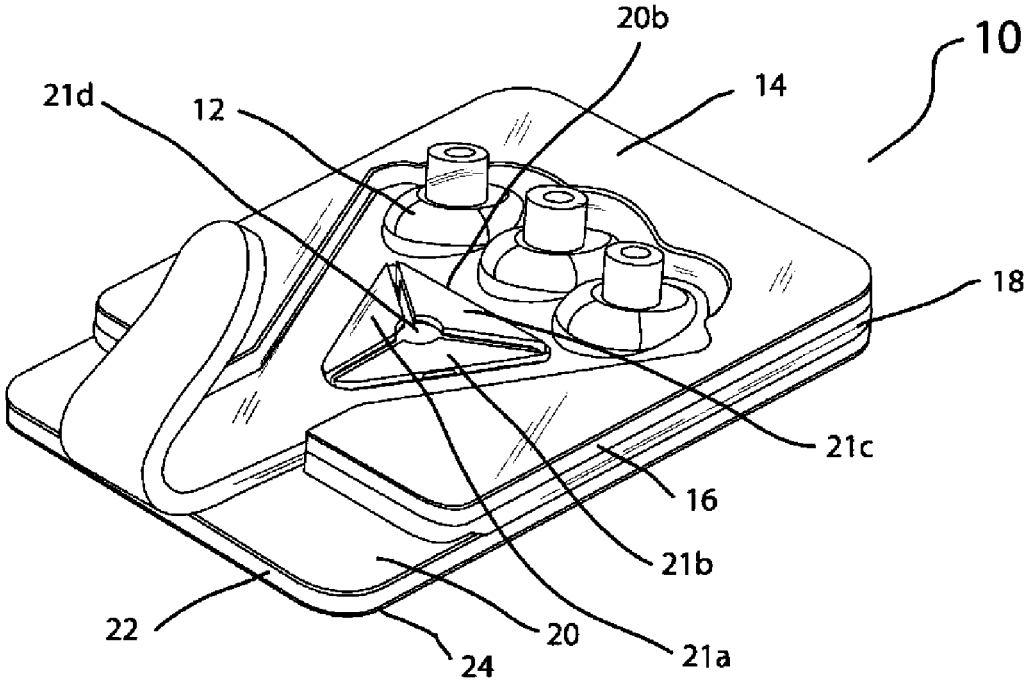
FIG. 2A shows a perspective view of the apparatus of FIG. 1 with the apparatus assembled.
Figure 2B:
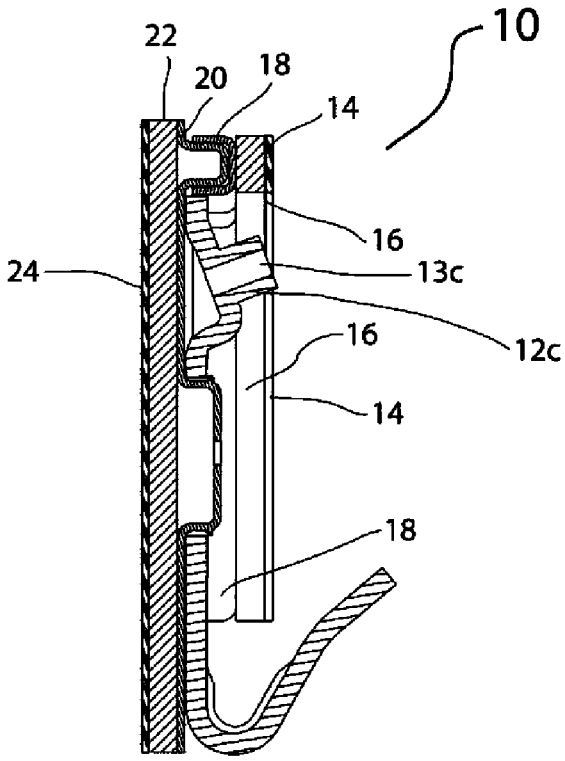
FIG. 2B shows a side cross sectional view of the apparatus of FIG. 1 with the apparatus assembled.

FIG. 1 shows a perspective view of an apparatus 10 in accordance with an embodiment of the present invention with the apparatus 10 shown taken apart. FIG. 2A shows a perspective view of the apparatus 10, with the apparatus 10 assembled. FIG. 2B shows a cross sectional view of the apparatus 10, with the apparatus 10 assembled.

The apparatus 10 is comprised of hanger 12, wax paper 14, a portion 16, an upper cap 18, a lower cap 20, a portion 22, and wax paper 24.

The hanger 12 can be made of metal. The hanger 12 has a hook portion 12*a*, a base portion 11*a*, a triangular opening 12*b*, and protrusions 12*c*, 12*d*, and 12*e*, having openings 13*c*, 13*d*, and 13*e*, respectively. Opening 13*c* of protrusion 12*c* is shown in FIG. 2B. The base portion 11*a* may be flat or substantially flat.

The wax paper 14 has an opening 14*a* into which the hanger 12 can be inserted. The portion 16 is comprised of a removable adhesive layer 16*a*, a foam tape 16*b*, and a permanent adhesive layer 16*c*. The portion 16 also has an opening 16*d* shown in FIG. 1, into which the hanger 12 can be inserted and snugly fit as shown in FIG. 2A. The base portion 11*a* of the hanger 12 can be inserted through the opening 14*a* and through the opening 16*d*, while the base portion 11*a* is parallel or substantially parallel to the wax paper 14, the opening 14*a*, the portion 16, and the opening 16*d*. The upper cap 18 has an opening 18*a* into which the hanger 12 can be inserted. The lower cap has a recess 20*a* shown in FIG. 1, into which the hanger 12 can be inserted as shown in FIG. 2A. The lower cap 20 has a triangular protrusion 20*b* which can be inserted into the opening 12*b* of the hanger 12.

The portion 22 is comprised of a permanent adhesive layer 22*a*, a foam tape 22*b*, and a removable adhesive layer 22*c*.

The wax paper 14 has an inner opening or slot 14*a* into which the metal hanger 12 snugly fits as shown by FIG. 2A. The portion 16 and the upper cap 18 have inner openings of slots 16*d* and 18*a* respectively, into which the metal hanger 12 snugly fits as shown by FIG. 2A. The lower cap 20 includes a recess 20*a* into which the metal hanger 12 snugly fits as shown by FIG. 2A. The lower cap 20 also includes a substantially triangular portion or protrusion 20*b*. The substantially triangular portion 20*b* may be of a type similar to that used for holding DVDs. The portion or protrusion 20*b* fits into the triangular portion 12*b* in order to hold the hanger 12 onto the lower cap 20. The substantially triangular portion 20*b* includes sections 21*a*, 21*b*, and 21*c* and central opening 21*d*.

Figure 2C:
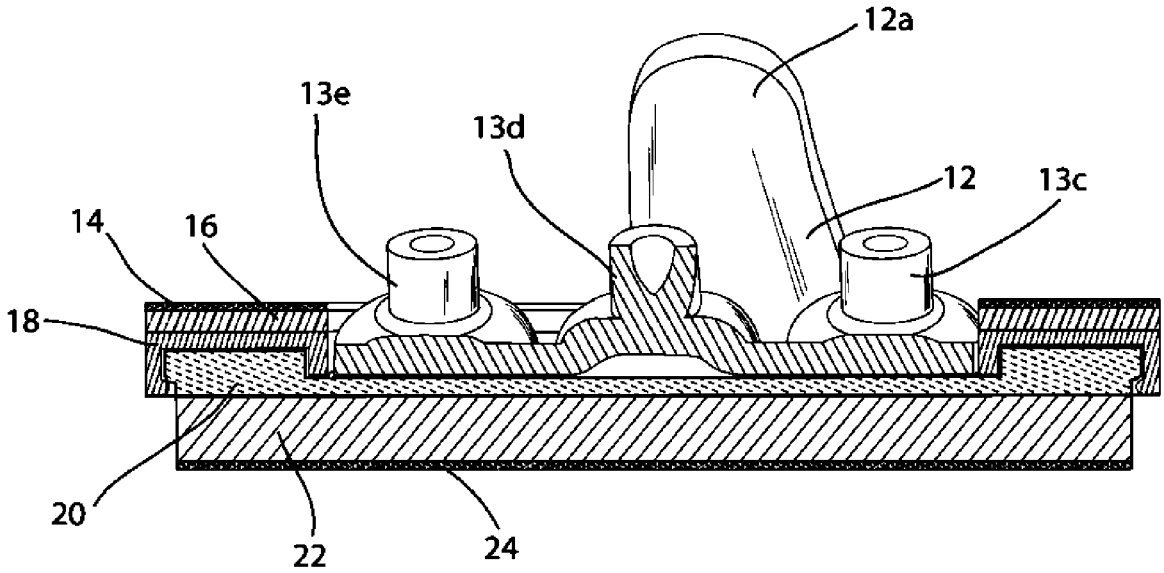
FIG. 2C shows a rear partial cross sectional view and a partial rear view of the apparatus of FIG. 1 with the apparatus assembled.

FIG. 2C shows a rear partial cross sectional view and a partial rear view of the apparatus 10 with the apparatus assembled. In FIG. 2C the hook portion 12*a* of the hook is shown. In addition the wax paper 14, portion 16, upper cap 18, lower cap 20, portion 22, and waxpaper 24 is shown in FIG. 2C. FIG. 2C also shows that the protrusions 13*e* and 13*c* are in line but are not in line with the protrusion 13*d*.

Figure 3A:
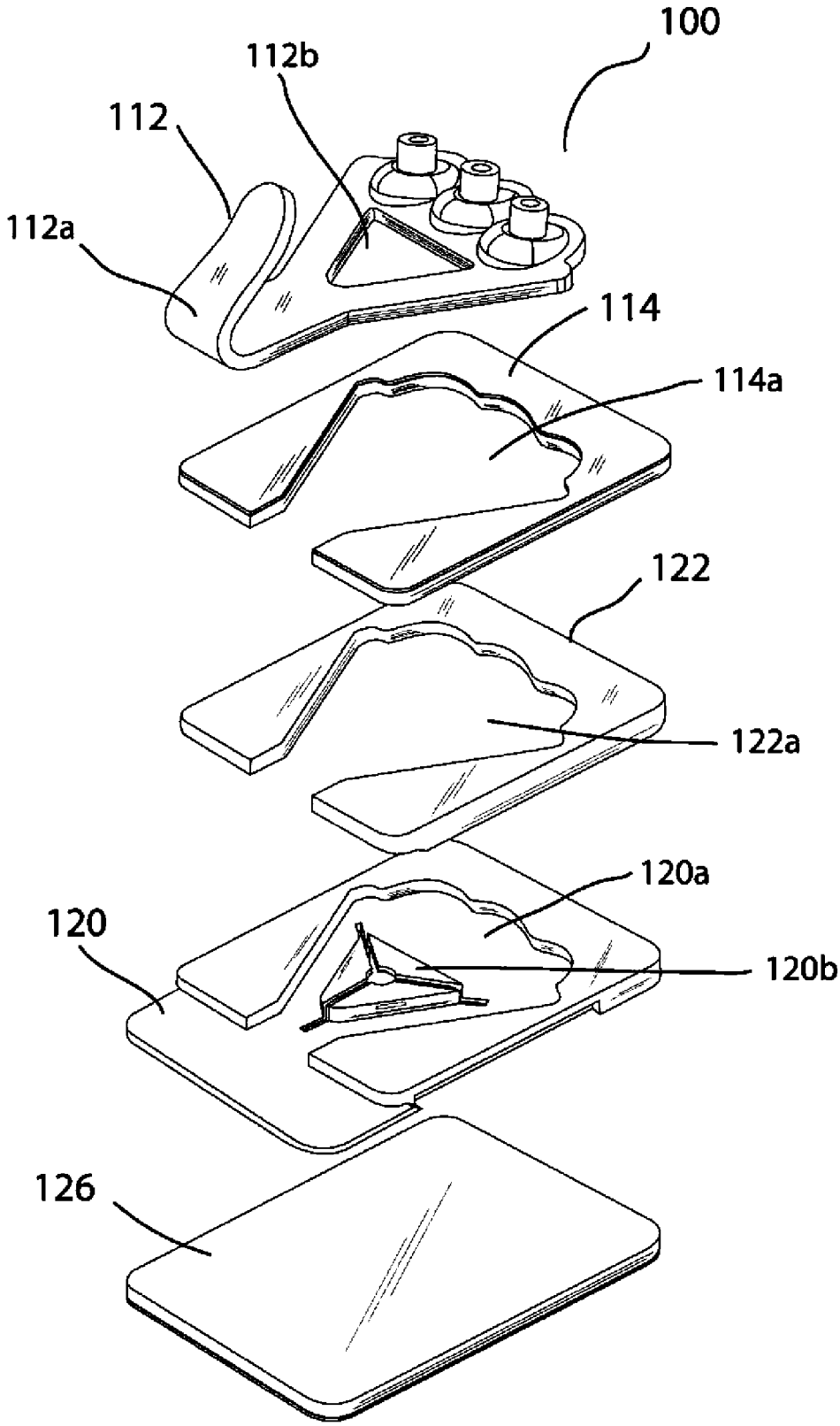
FIG. 3A shows a perspective view of a second apparatus in accordance with another embodiment of the present invention with the second apparatus shown taken apart.
Figure 3C:
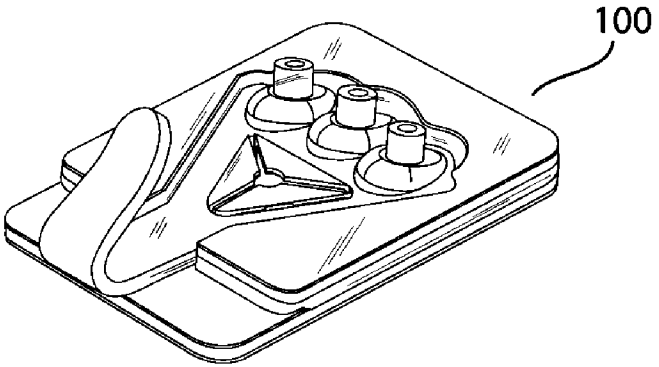
FIG. 3C shows a perspective view of the apparatus of FIG. 3A with the apparatus assembled.
Figure 3B:
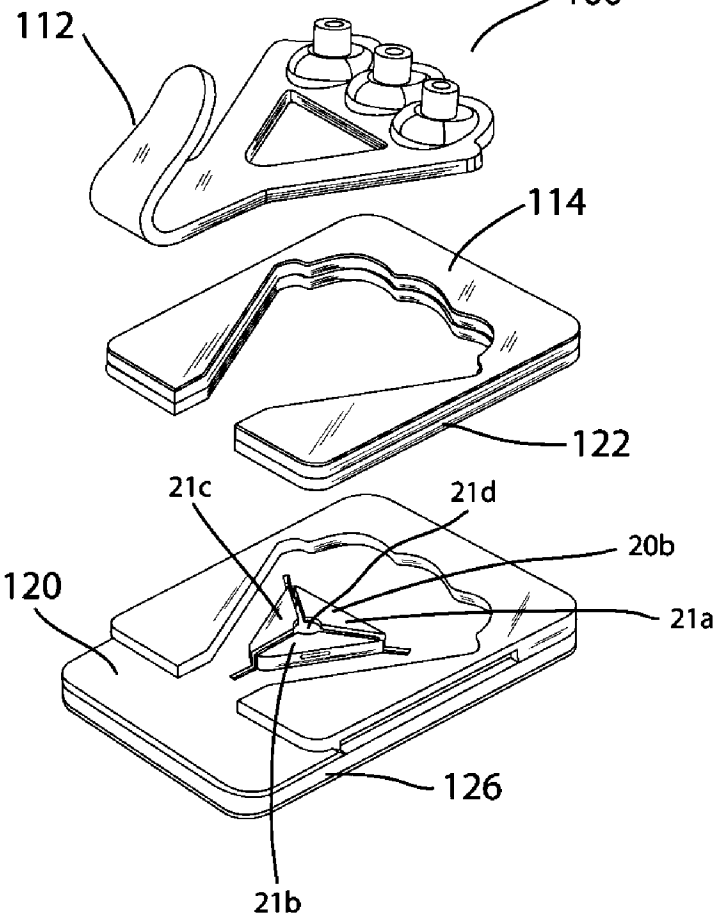
FIG. 3B shows a perspective view of the apparatus of FIG. 3A with the apparatus shown partially put together.

FIG. 3A shows a perspective view of an apparatus 100 in accordance with another embodiment of the present invention with the apparatus 100 shown taken apart. FIG. 3B shows a perspective view of the apparatus 100 of FIG. 3A with the apparatus 100 shown partially put together. FIG. 3C shows a perspective view of the apparatus 100 of FIG. 3A with the apparatus 100 assembled.

The apparatus 100 is comprised of hanger 112, portion 114, an upper cap 122, a lower cap 120, and portion a 126. The hanger 112 may include a hook 112*a* and a triangular opening 112*b*, and may be identical to hanger 12 of FIG. 1. The portion 114 may have an inner opening or slot 114*a* into which the hanger 112 can be snugly inserted as shown in FIG. 3C. The portion 122 has an inner opening or slot 122*a* into which the hanger 112 can be snugly inserted as shown in FIG. 3C. The portion 120 has a recess 120*a* and an inner protrusion 120*b* (marked in FIG. 3A). The metal hanger 112 can be inserted into the recess 120*a* so that the inner protrusion 120*b* is inserted through the opening 112*b* in the hanger 112.

Figure 4A:
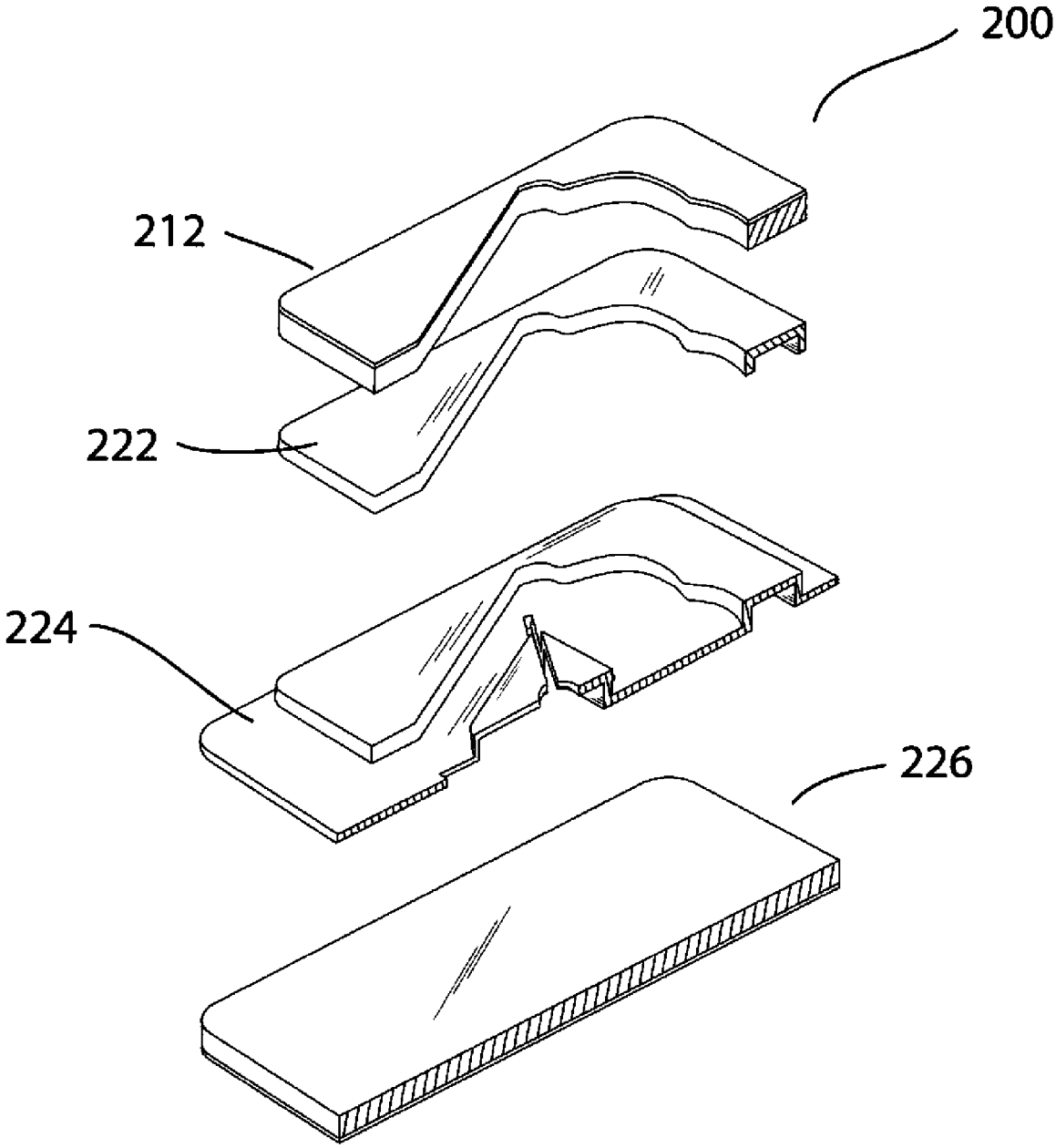
FIG. 4A shows a perspective view of a third apparatus in accordance with another embodiment of the present invention with the third apparatus shown taken apart.
Figure 4C:
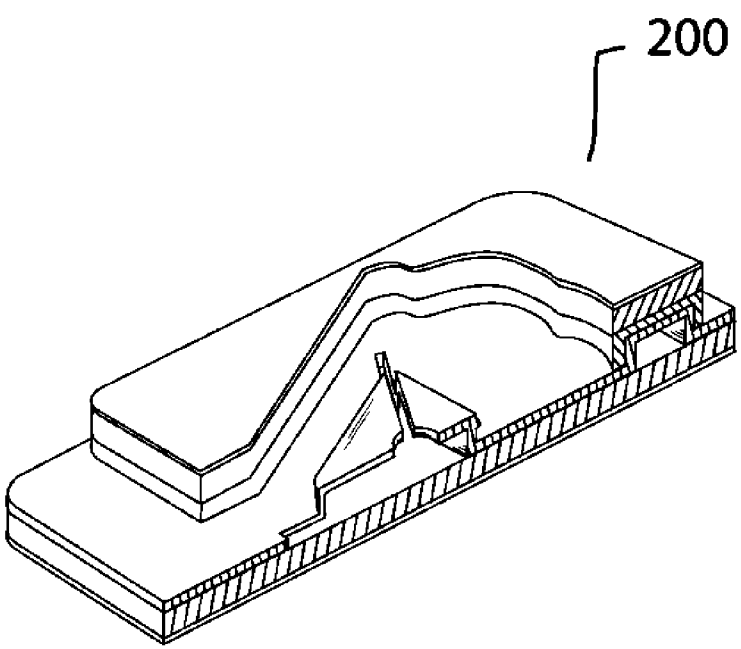
FIG. 4C shows a perspective view of the apparatus of FIG. 4A with the apparatus assembled.
Figure 4B:
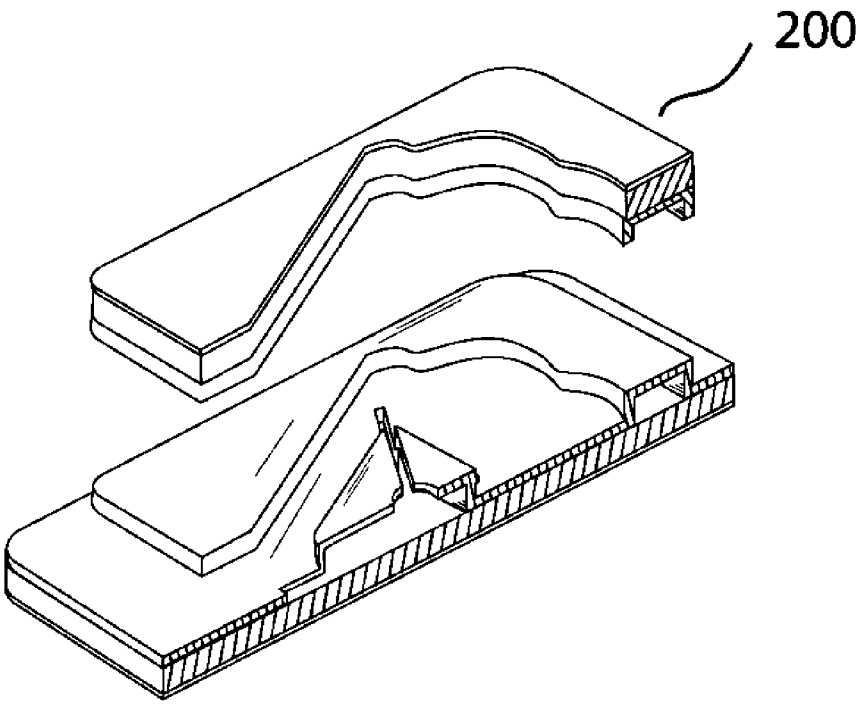
FIG. 4B shows a perspective view of the apparatus of FIG. 4A with the apparatus shown partially put together.

FIG. 4A shows a perspective view of an apparatus 200 in accordance with another embodiment of the present invention with the apparatus 200 shown taken apart. FIG. 4B shows a perspective view of the apparatus 200, with the apparatus 200 shown partially put together. FIG. 4C shows a perspective view of the apparatus 200 with the apparatus assembled.

The apparatus 200 is comprised of portion 212, an upper cap 222, a lower cap 224, and a portion 226. The portion 212 may be comprised of wax paper, similar to 14 in FIG. 1 and foam tape, similar to 16 in FIG. 1. Wax paper 14 is for protecting the adhesive layer 16*a* of the foam tape 16 from exposing to the outside. The adhesive layer 16*a* is a temporary or removable adhesive layer and 16*c* is a permanent adhesive layer so the portion 212 is adhered permanently to upper cap 222. The temporary adhesive layer 16*a* is used for easier removal of portions 212 and upper cap 222 from a wall after a metal hanger, such as 12 is firmly nailed on a wall. Same theory is applied to lower cap 224 and portion 226, except they are to be removed from the picture frames.

Figure 5A:
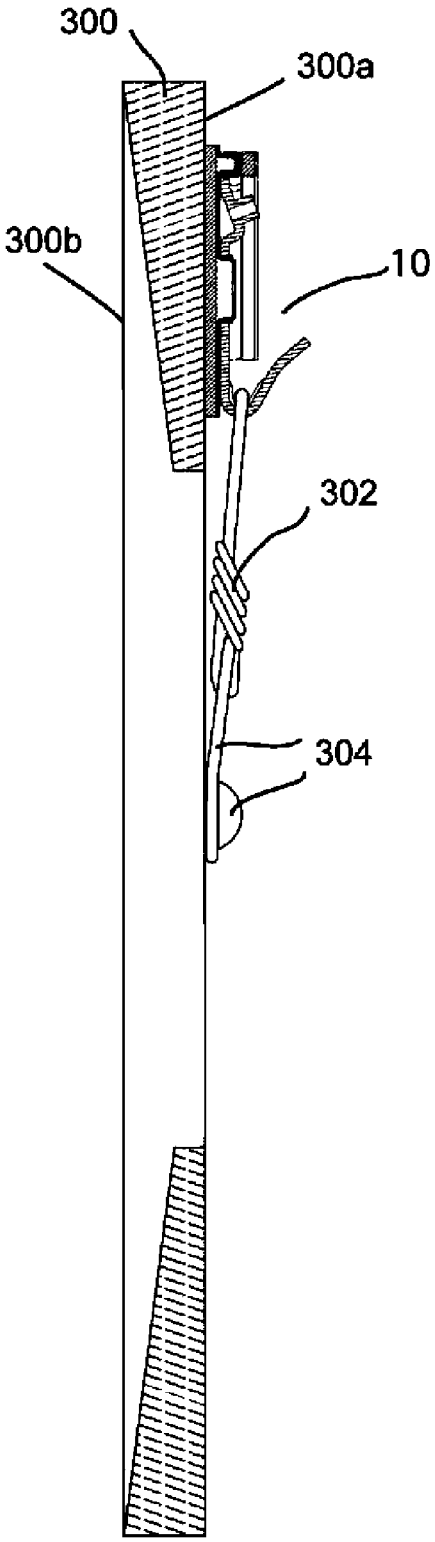
FIG. 5A is a cross sectional view of a picture frame, the apparatus of FIG. 1, a wire, and a wood frame hanger in a first state.
Figure 5B:
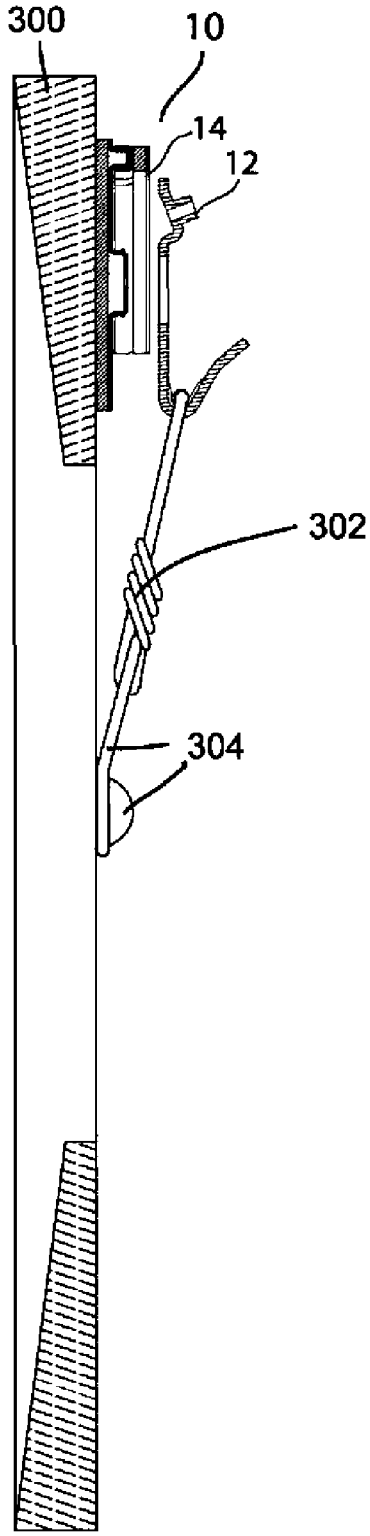
FIG. 5B is a cross sectional view of the picture frame, the apparatus of FIG. 1, the wire, and the wood frame hanger in a second state.
Figure 5C:
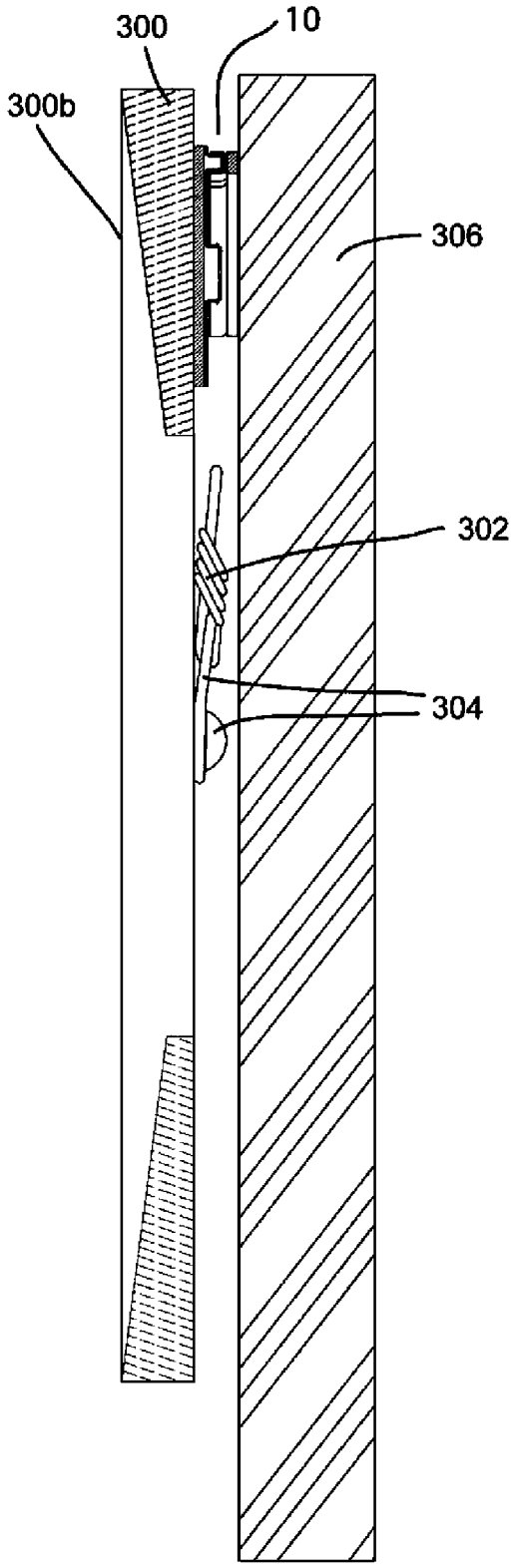
FIG. 5C is a cross sectional view of the picture frame, part of the apparatus of FIG. 1, the wire, the wood frame hanger in a third state, and a wall.

FIG. 5A is a cross sectional view of a picture frame 300, the apparatus or positioner 10 of FIG. 1, a wire 302, fastened on a metal wood frame hanger 304 attached to the picture frame 300 in a first state. FIG. 5B is a cross sectional view of the picture frame 300, the apparatus 10 of FIG. 1, the wire 302, and the wood frame hanger 304 in a second state. FIG. 5C is a cross sectional view of the picture frame 300, part of the apparatus 10 of FIG. 1, the wire 302, the wood frame hanger 304 in a third state, and a wall 306.

Figure 5D:
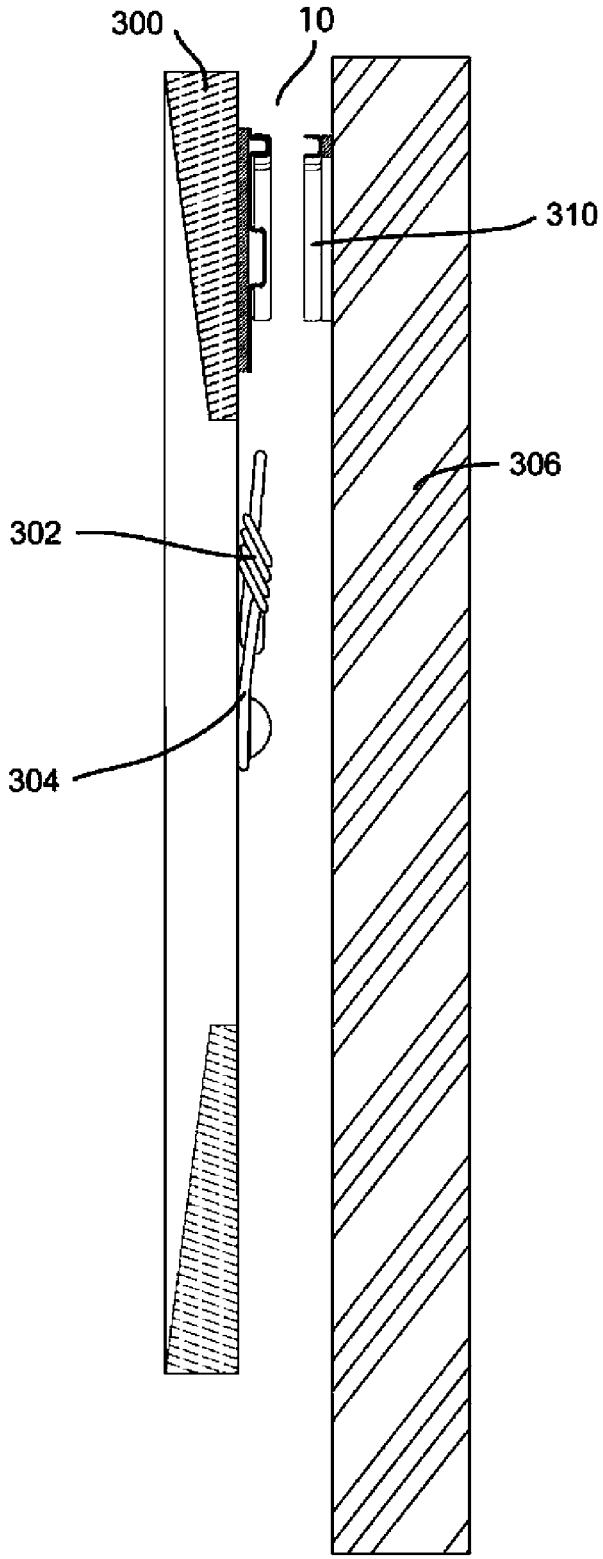
FIG. 5D is a cross sectional view of the picture frame, part of the apparatus of FIG. 1, the wire, the wood frame hanger in a fourth state and a wall.
Figure 5E:
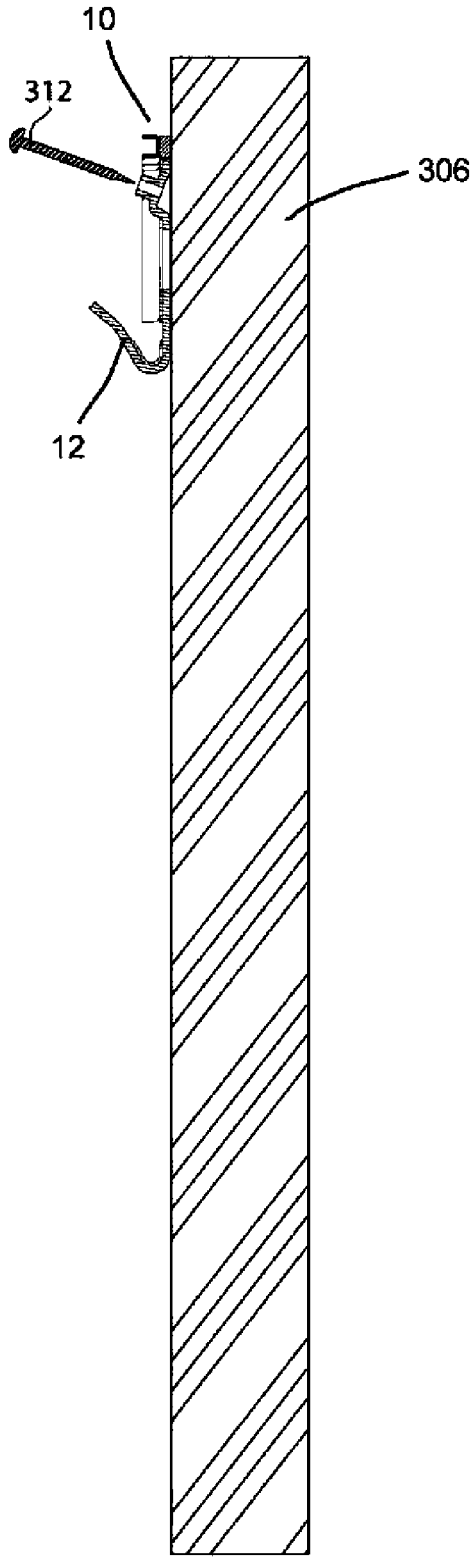
FIG. 5E is a cross sectional view of part of the apparatus of FIG. 1 and a nail in a fifth state, and the wall.
Figure 5F:
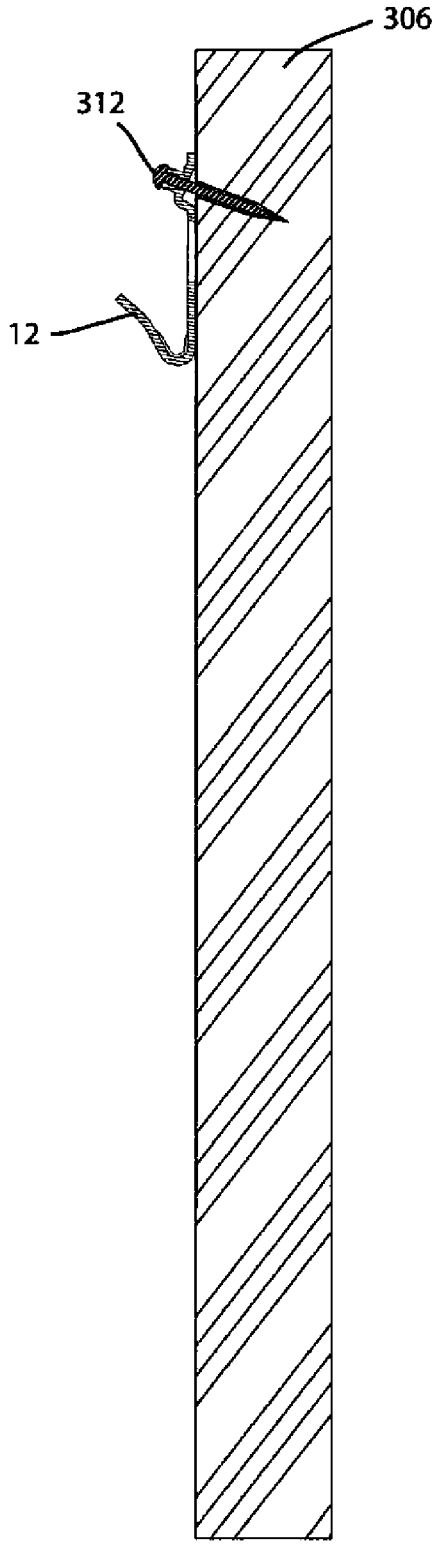
FIG. 5F is a cross sectional view of part of the apparatus of FIG. 1 and a nail in a sixth state, and the wall.
Figure 5G:
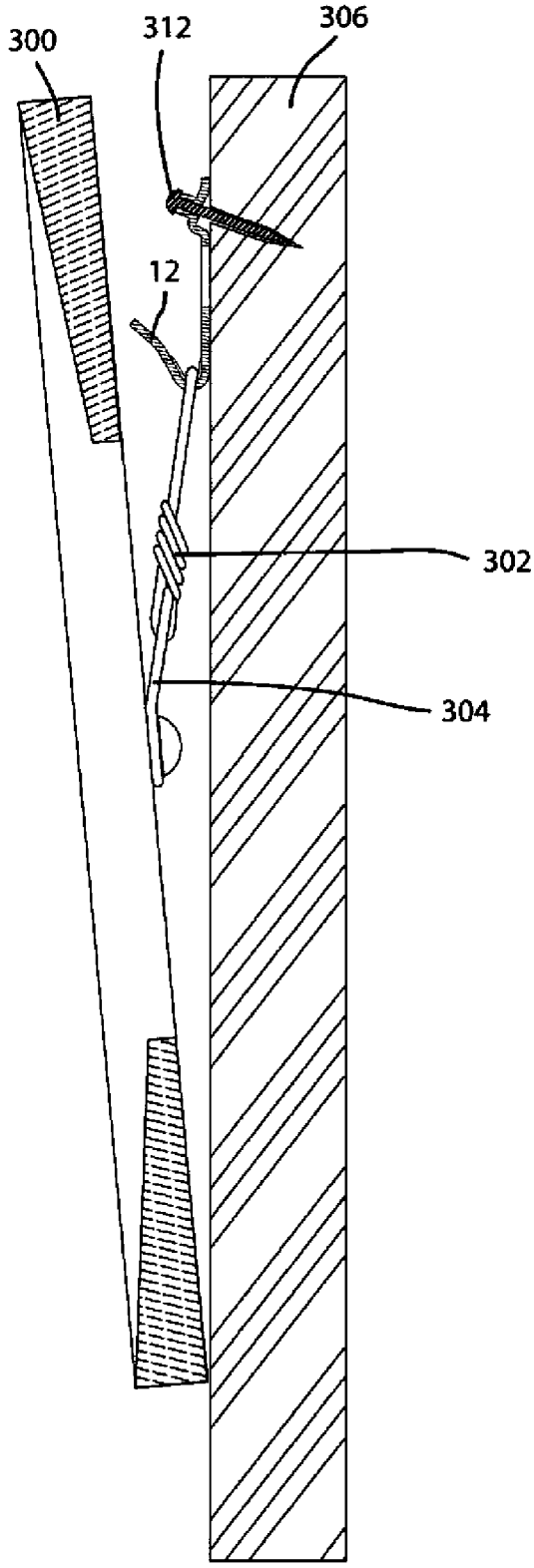
FIG. 5G is a cross sectional view of the picture frame, part of the apparatus of FIG. 1, the wire, the nail, and the wood frame hanger in a seventh state, and the wall.

FIG. 5D is a cross sectional view of the picture frame 300, part of the apparatus 10 of FIG. 1, the wire 302, the wood frame hanger 304 in a fourth state and a wall 306. FIG. 5E is a cross sectional view of part of the apparatus 10 of FIG. 1 and a nail 312 in a fifth state, and the wall 306. FIG. 5F is a cross sectional view of the part of the apparatus 10 of FIG. 1 and a nail 312 in a sixth state, and the wall 306. FIG. 5G is a cross sectional view of the picture frame 300, part of the apparatus 10 of FIG. 1, the wire 302, the nail 312, and the wood frame hanger 304 in a seventh state, and the wall 306.

In operation, with the wax paper 24 removed from the foam tape 22, of the apparatus 10 or positioner 10, the middle of the frame 300 is located and the apparatus 10 is hooked onto the wire 302 and adhered onto a back 300*a* of the frame 300 as shown as FIG. 5A. The metal hanger 12 is detached from the apparatus or positioner 10, along with a wire 302 and the wax paper 14 on the temporary adhesive 16 as shown in FIG. 5B. With the hanger 12 removed from the wire 302, the frame 300 is positioned and an individual presses down on the front 300*b* of the frame 300 so as to let the upper cap 18 adhere to the wall 306, as shown in FIG. 5C. Next the upper cap 18 is disengaged from the lower cap 20, as shown in FIG. 5D. Next the hanger 12 is put back into the upper cap 18 (mounted on a wall) so its position is defined as shown in FIG. 5E. A nail 312 is applied as shown in FIGS. 5E. The upper cap 18 is removed from the wall after the hanger 12 is nailed on the wall as shown in FIG. 5F. Finally the picture frame 300, with the lower cap 20 removed, is hung back on the wall 306 as shown in FIG. 5G.

The hangers 12 can be made of metal or another material. The hangers 12 can be of different shapes.

Figure 6A:
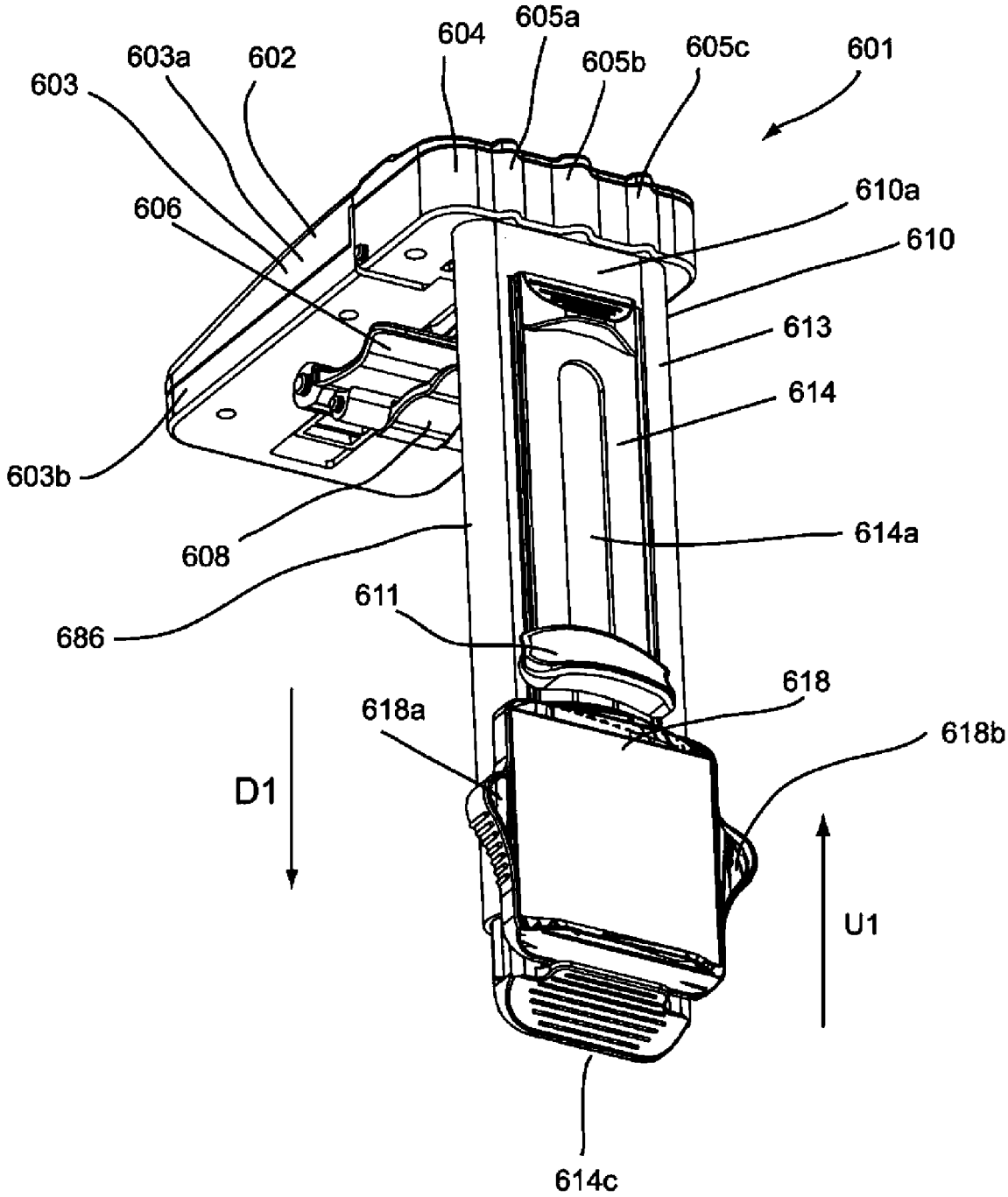
FIG. 6A shows a perspective view of an apparatus in accordance with another embodiment of the present invention.
Figure 6B:
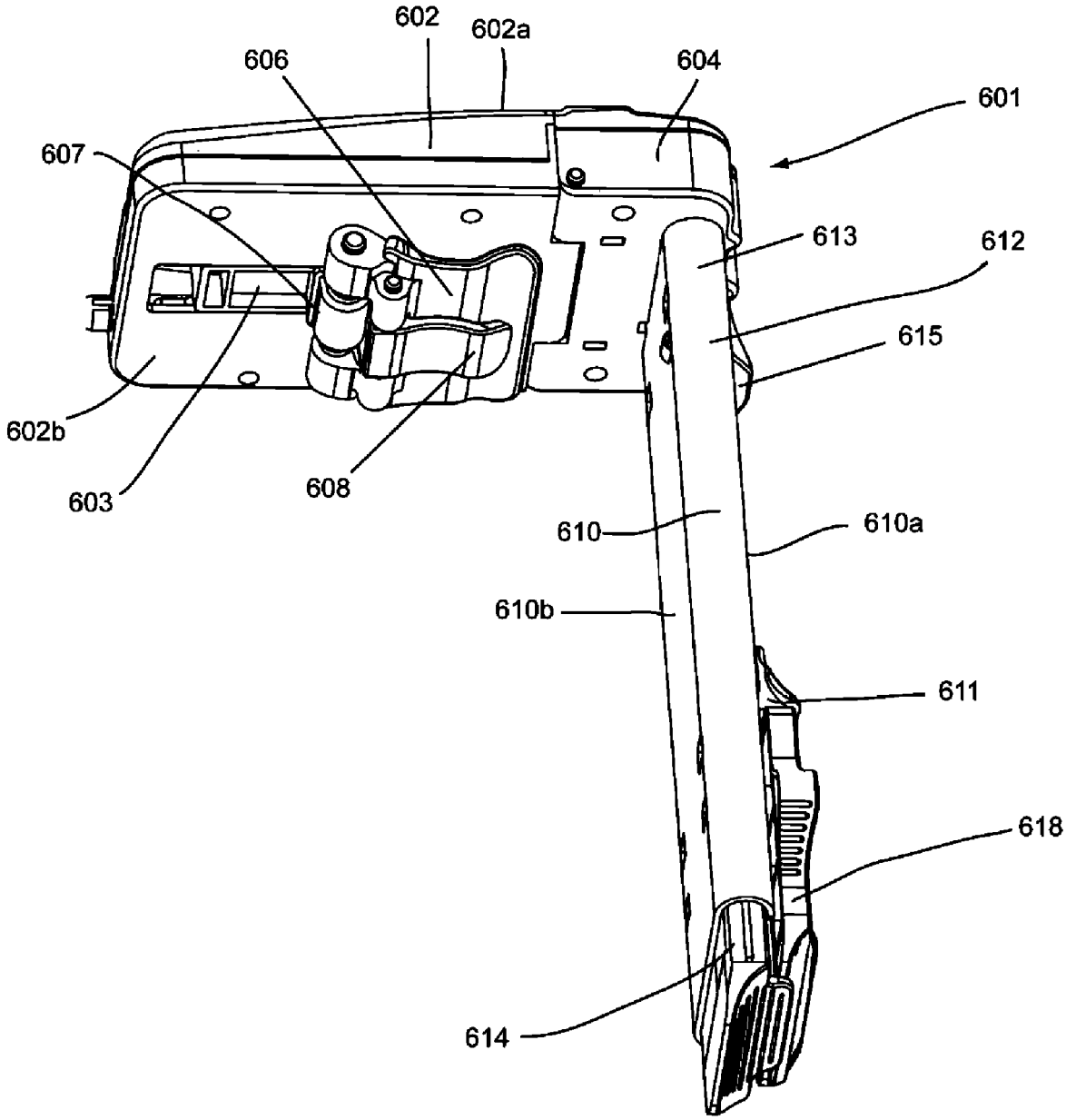
FIG. 6B shows another perspective view of the apparatus of FIG. 6A.
Figure 6C:
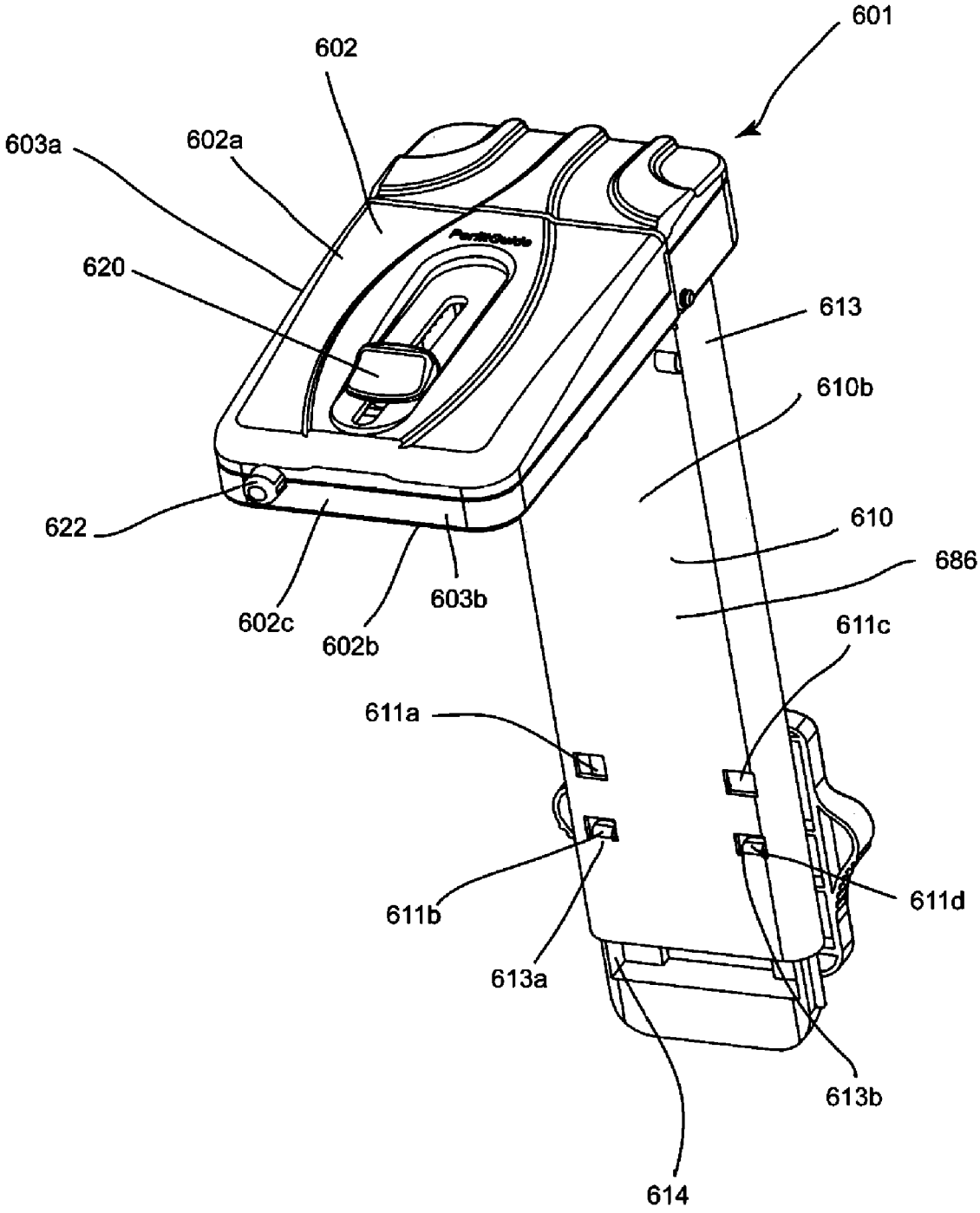
FIG. 6C shows another perspective view of the apparatus of FIG. 6A.
Figure 10:
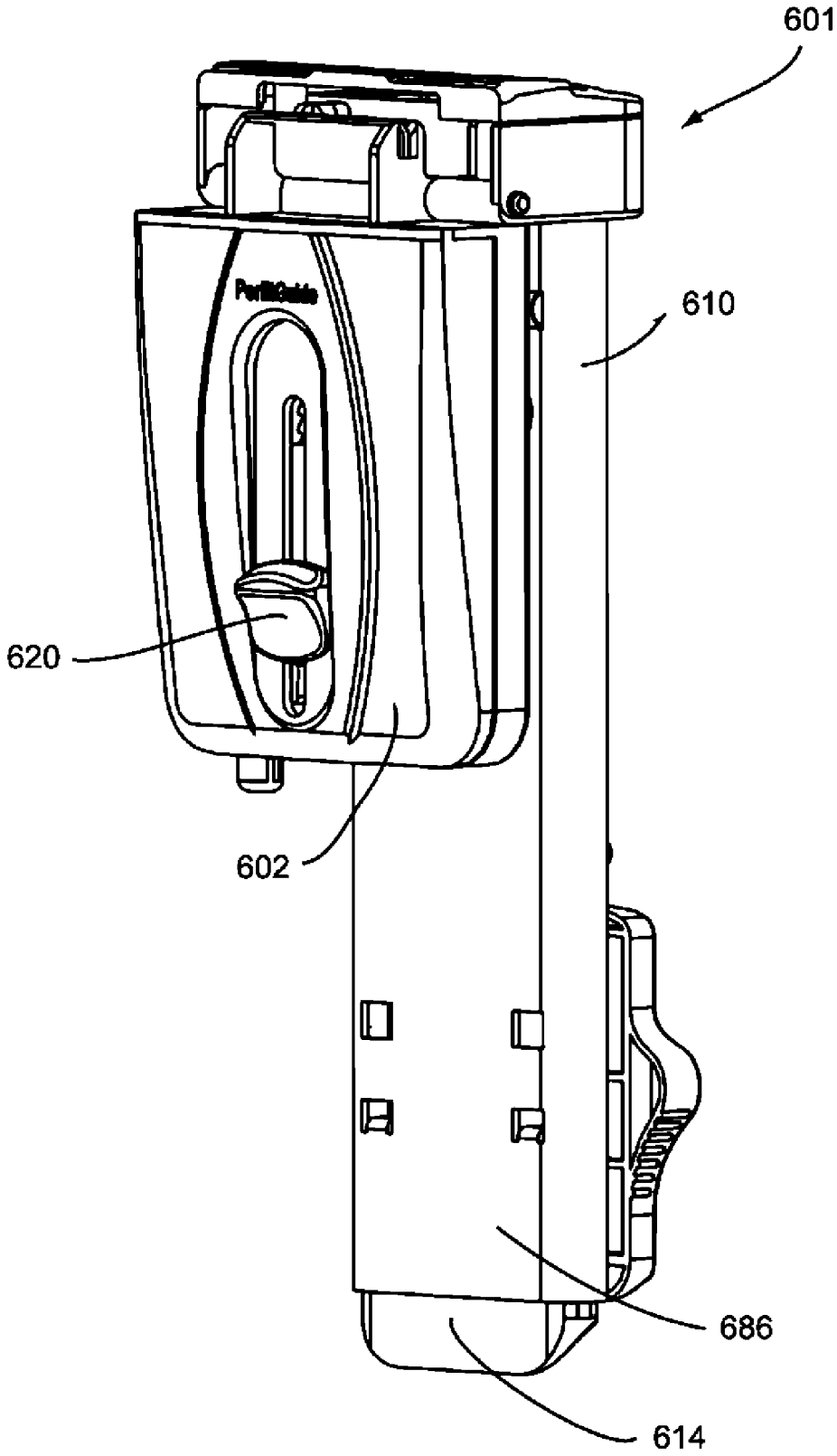
FIG. 10 shows a perspective view of the apparatus of FIG. 6A with a main body folded downwards so that it lies substantially parallel to an extension portion.

FIGS. 6A-C show perspective views of an apparatus 601 in accordance with an embodiment of the present invention. Referring to FIGS. 6A-C, the apparatus 601 includes a main body 602, a portion 604, and an extension portion 610. The main body 602 has a housing 603 with a top half 603*a* and a bottom half 603*b*. The housing 603 can be separated into the top half 603*a* and the bottom half 603*b* revealing components, such as shown within the bottom half 603*b* in FIG. 13. The extension portion 610 is shown at about a right angle (ninety degrees) with respect to the main body 602. However, the main body 602 can be foldable with respect to the extension portion 610, as shown by FIG. 10, in which the main body 602 is substantially parallel to the extension portion 610. The foldable feature may allow for easy packing of the apparatus 601.

The main body 602 has a top surface 602*a*, shown in FIG. 6C, and a bottom surface 602*b*, shown in FIG. 6B. The main body 602 is connected to or includes a frame clamp 606 and a handle 608 shown in FIGS. 6A-B. The portion 604 of the apparatus 601 has ridges 605*a*, 605*b*, and 605*c*, which are used to create a space or cavity for extension portion 610 to be inserted into portion 604. The extension portion 610 includes a metal housing 612 shown in FIG. 6B, an extension arm 614, a base 618 and a base release 611, shown in FIG. 6A. The extension portion 610 has a front side or surface 610*a* and a rear side or surface 610*b*, as shown by FIGS. 6A-B, respectively. The base 618 has protruding ridges 618*a* and 618*b*, which are for easy gripping and pushing the base 618 upwards in the direction U1 or downwards in the direction D1, as shown in FIG. 6A. The extension arm 614 has an opening or slot 614*a* for the sliding up and down and traveling of base 618 and base release 611 within the opening slot 614*a*.

Figure 12:
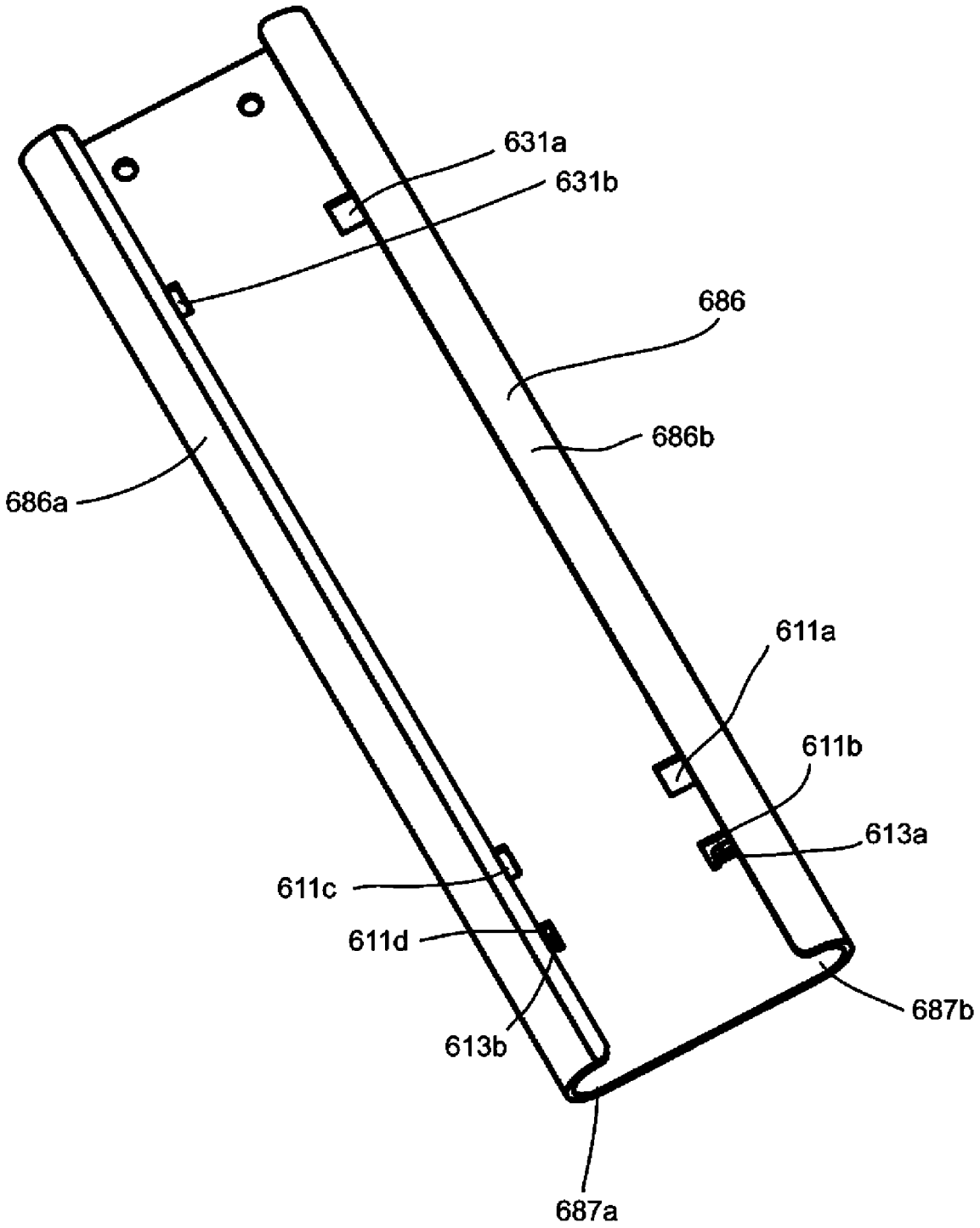
FIG. 12 shows a perspective view of part of the extension portion of the apparatus of FIG. 6A.

The extension portion 610 includes insert 686 shown in FIG. 6C and FIG. 12. The insert 686 has overlapping or U-shaped portions 686*a* and 686*b* which form channels 687*a* and 687*b*. The extension arm 614 slides in these channels 687*a* and 687*b*, in order to effectively elongate the extension portion 610.

Referring to FIG. 6C, a push button 620 protrudes from the top surface 602*a* of the main body 602. The push button 620 is connected to frame clamp 606 and handle 608 and travels together with frame clamp 606 and handle 608. The rear side or surface 610*b* of the extension portion 610 has openings 611*a-d*, as shown in FIG. 6C. Openings 611*b* and 611*d*, in conjunction with protrusions 613*a* and 613*b*, act as stoppers to prevent extension arm 614 from falling out of the extension insert 686 of the extension portion 610. Each of the protrusions 613*a-b* are bent upwards in a ninety degree angle. The protrusions 613*a-b* can be forced out of the openings 611*b* and 611*d* and the extension arm 614 within the channels 687*a* and 687*b* of the insert 686 until the protrusions 613*a-b* are inserted into openings 611*a* and 611 *c*, or 631*a* and 631*b*, respectively. The extension arm 614 is also held in position by two metal springs 630 and 632 shown in FIG. 8, inside extension arm 614.

Figure 7A:
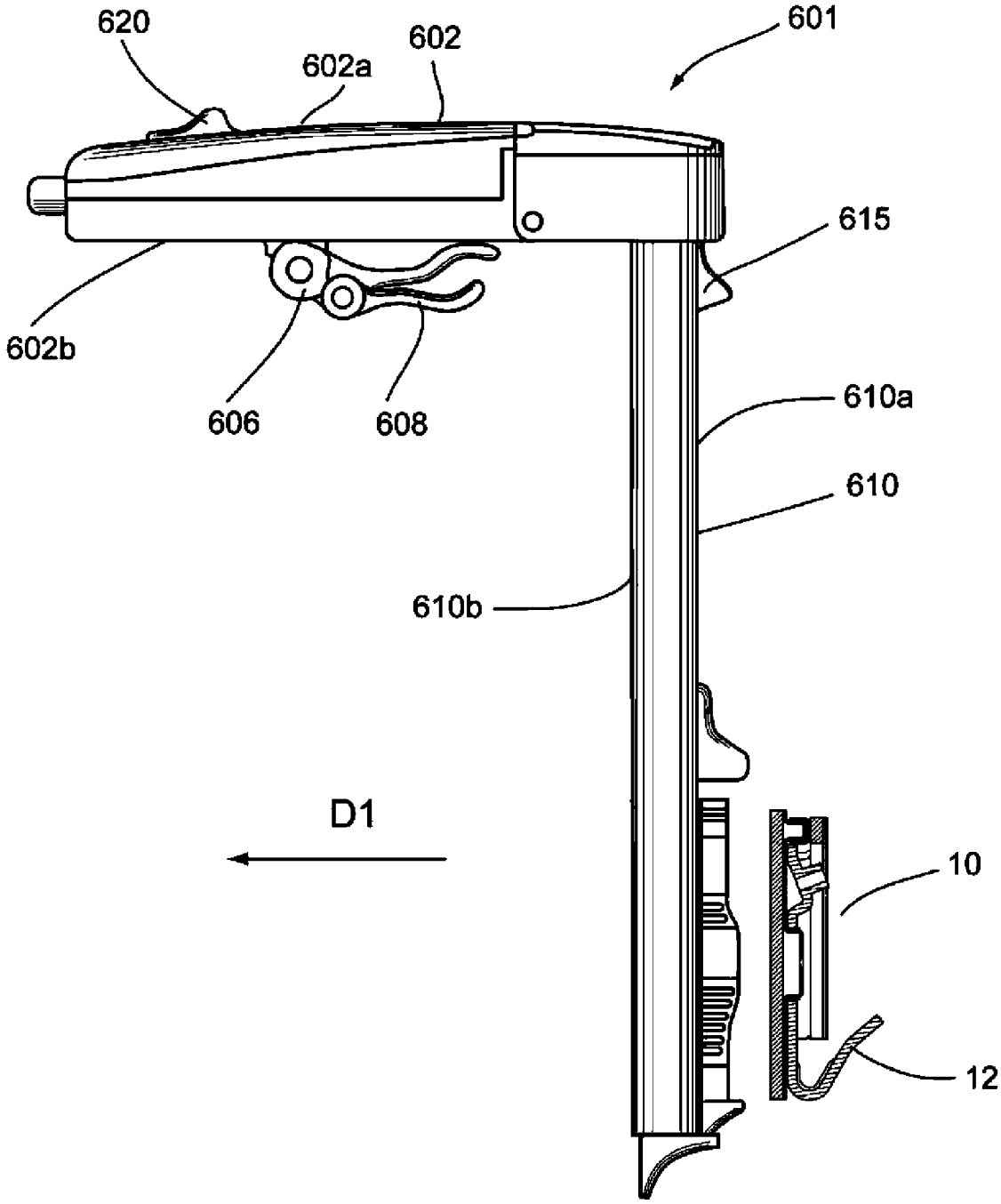
FIG. 7A shows a side view of the apparatus of FIG. 6A in a first state.

FIG. 7A shows a side view of the apparatus 601 in a first state. In this first state, the clamp 606 and handle 608 are closed and press against the side or bottom surface 602*b* of the portion 602. There is a button 615 near the top of the extension portion 610 in FIG. 7A. The button 615 is part of extension portion 610, opposite of bottom or end 614*c*. FIG. 7A also shows apparatus 10 with hanger 12, with waxpaper 24 shown in FIG. 2B removed, ready to adhere on base 618.

Figure 7B:
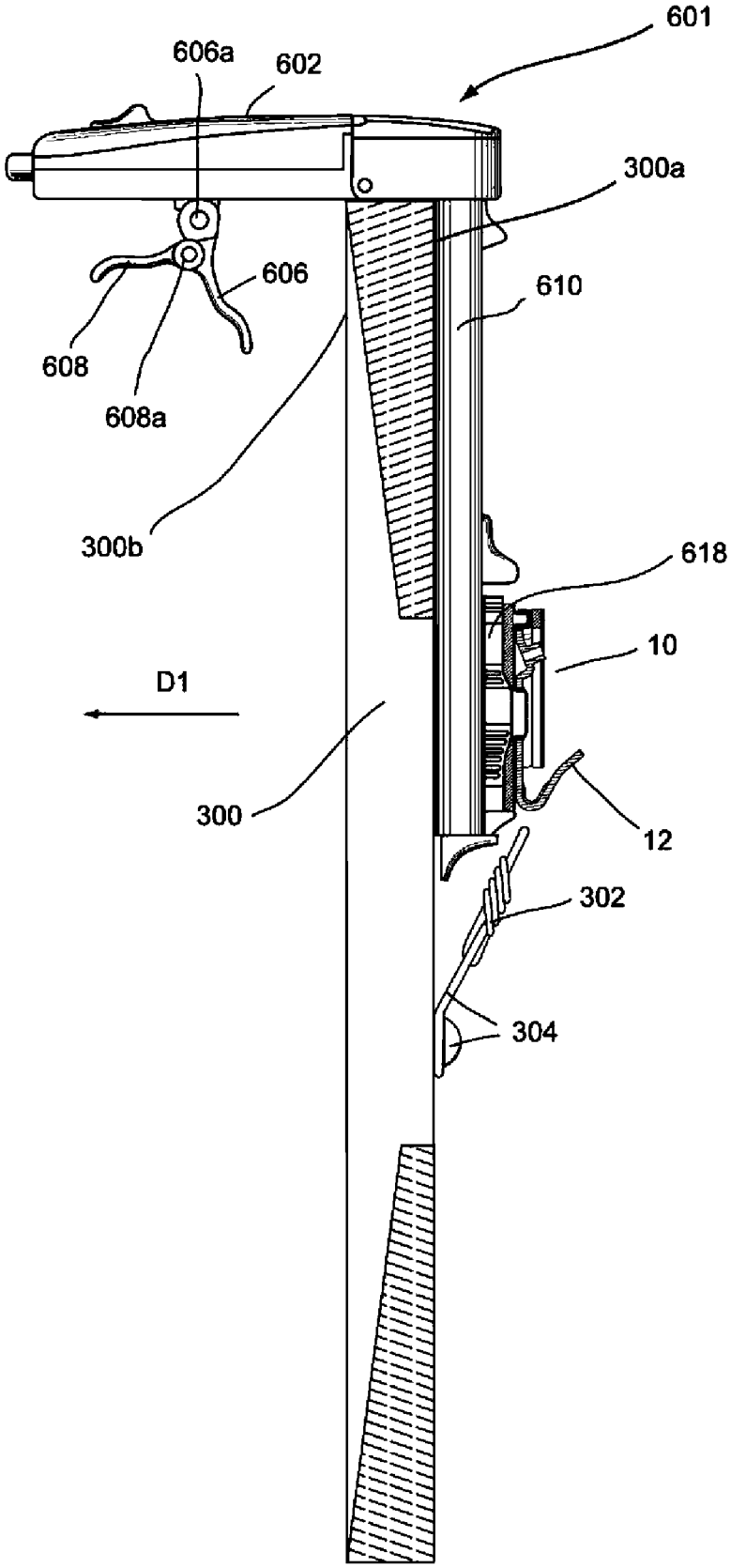
FIG. 7B shows a side view of the apparatus of FIG. 6A in a second state, along with the frame of FIGS. 5A-5B, and the apparatus of FIG. 2B.

FIG. 7B shows a side view of the apparatus 601 in a second state, along with the back of the frame 300 facing towards side 610*b*, and the apparatus 10. In this second state, the handle 608 and the clamp 606 have been rotated clockwise about pivot points 608*a* and 606*a*, respectively from the position shown in FIG. 7A to the position shown in FIG. 7B. There is a spring 609 shown in FIG. 9 which biases the clamp 606 in the counter clockwise direction. This is done to allow the frame 300 to be easily inserted into the position shown in FIG. 7B adjacent the extension portion 610. A base 607 shown in FIG. 6B, to which the handle 608 and the clamp 606 have been attached has been slid in a direction D1 from the position in FIG. 7A to the position in FIG. 7B, inside a slot 603. In addition in FIG. 7B, the apparatus 10 is adhered on base 618 of the apparatus 601.

Figure 7C:
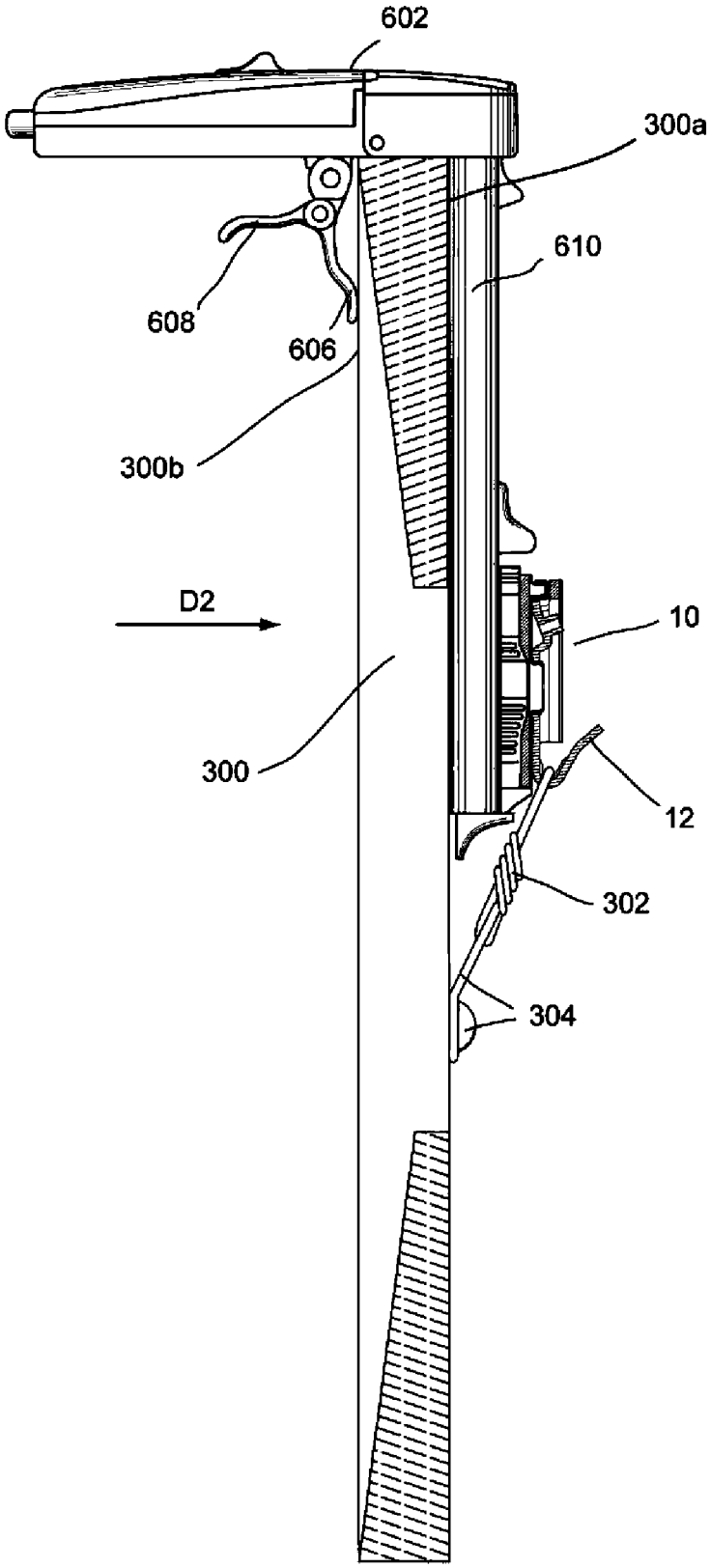
FIG. 7C shows a side view of the apparatus of FIG. 6A in a third state, along with the frame of FIGS. 5A-5B, and the apparatus of FIG. 2B.

FIG. 7C shows a side view of the apparatus 601 in a third state, along with the frame 300, (back 300*a* of the frame 300 facing towards side 610*b* of the extension portion 610, and the apparatus 10. In this third state, the base 607, to which the clamp 606 and the handle 608 have been attached, has been slid in a direction D2. In addition, the spring 609 shown in FIG. 9, makes the clamp 606 biased in a counterclockwise direction to press against the front 300*b* of the frame 300. The clamp 606 has been rotated in a counter clockwise direction so that the clamp 606 is now contacting the front 300*b* of the frame 300 and holding the back 300*a* of the frame 300 in place against side 610*b* of the extension portion 610. In addition wire or cord 302 is attached on hanger 12.

Figure 7D:
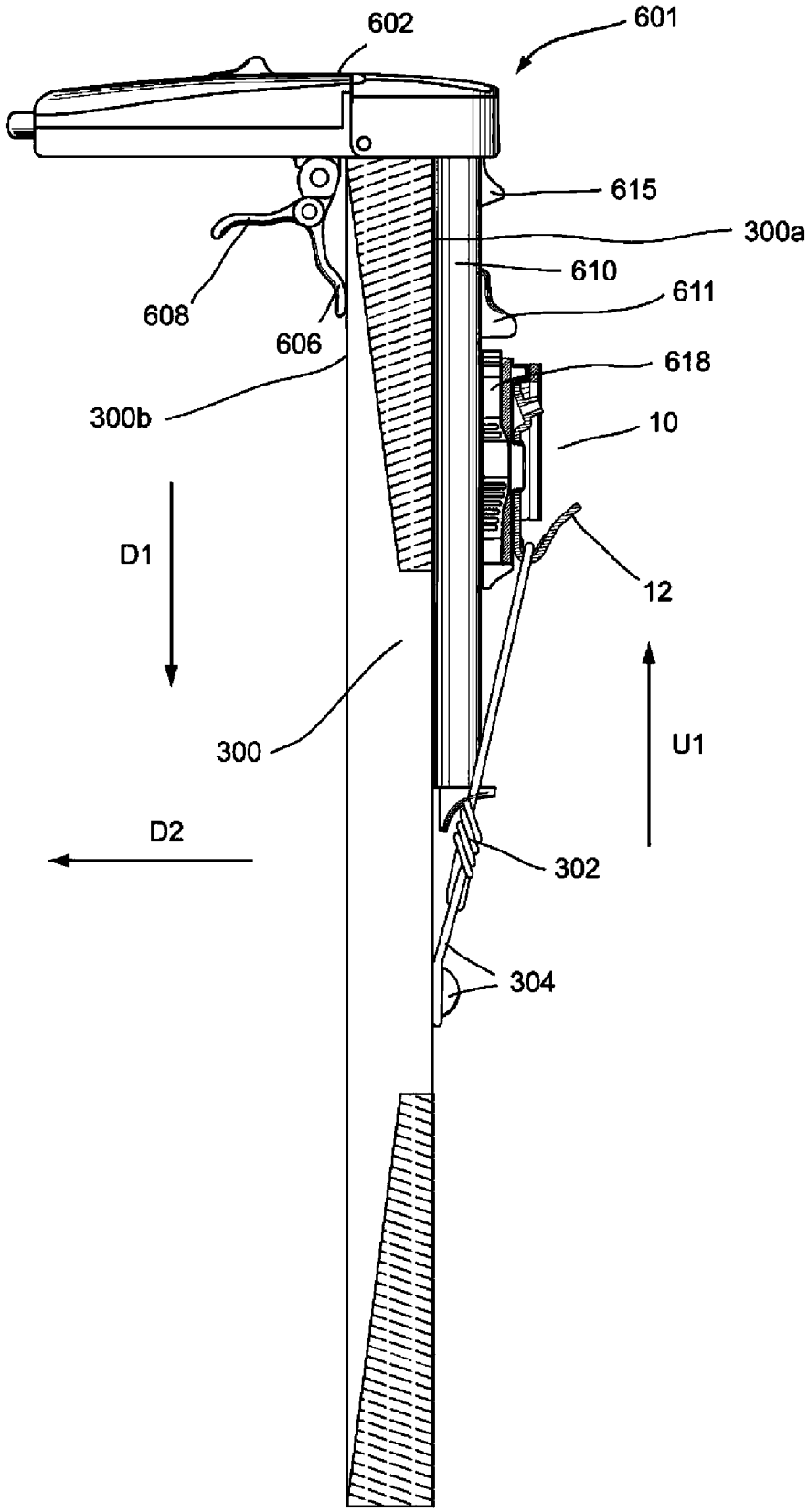
FIG. 7D shows a side view of the apparatus of FIG. 6A in a fourth state, along with the frame of FIGS. 5A-5B, and the apparatus of FIG. 2B.

FIG. 7D shows a side view of the apparatus 601 in a fourth state, along with the frame 300 and the apparatus 10. In the fourth state, (with the cord 302 attached on the hanger 12) the apparatus 10 and the base 618, to which it has been attached, has been slid up in the direction U1 until the cord 302 is tightened. The base 618 can slide up or down. However, there is a locking mechanism inside to prevent the base 618 from going down unless the base release 611 is pushed in the direction D1 shown in FIG. 7D. The base 618 can slide up or down within limits in the slot 614*a* of the extension arm 614 of the extension portion 610.

Figure 7E:
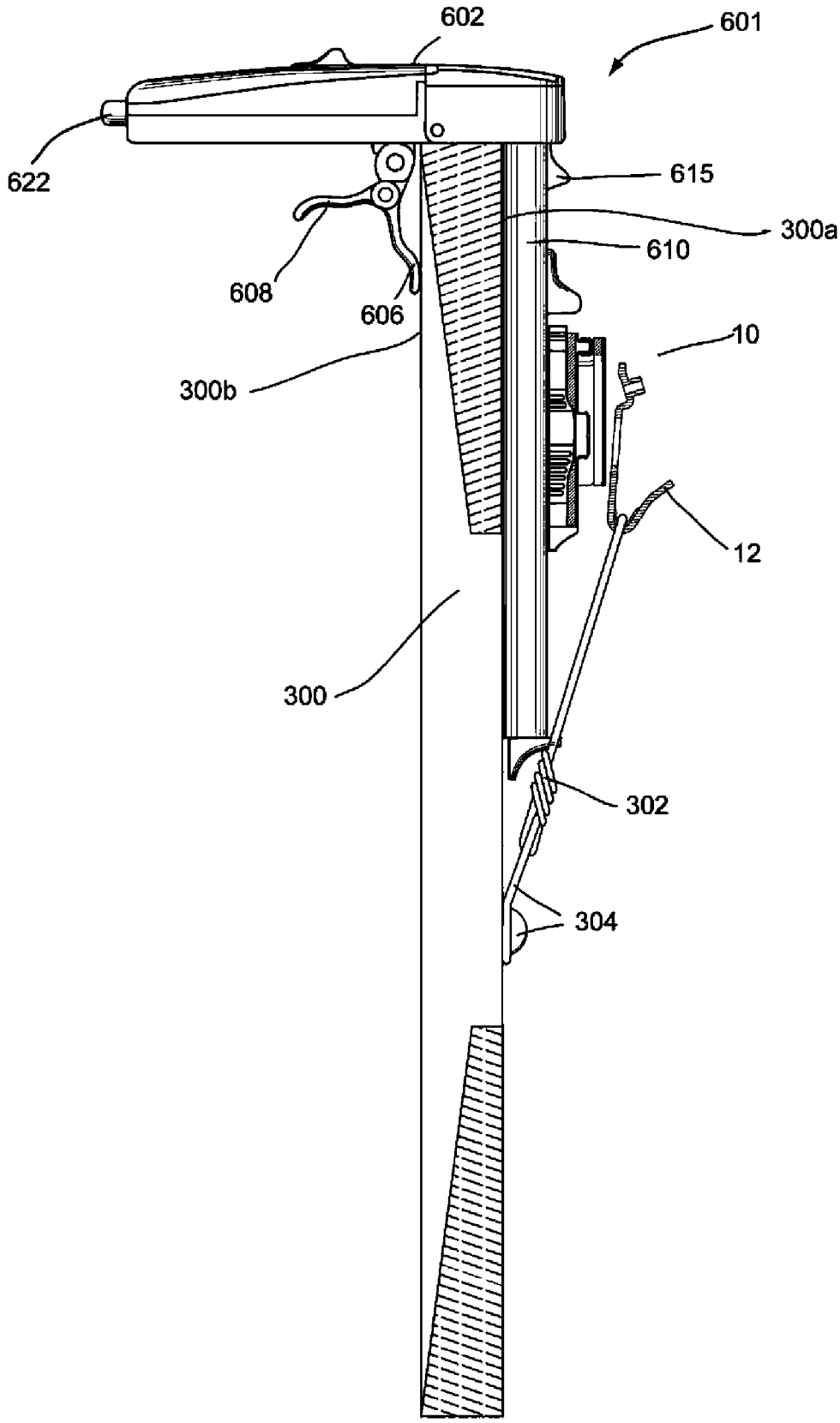
FIG. 7E shows a side view of the apparatus of FIG. 6A in a fifth state, along with the frame of FIGS. 5A-5B, and the apparatus of FIG. 2B.

FIG. 7E shows a side view of the apparatus 601 in a fifth state, along with the frame 300, and the apparatus 10. In the fifth state, the hanger 12, along with the cord 302 has been removed from the apparatus 10.

Figure 7F:
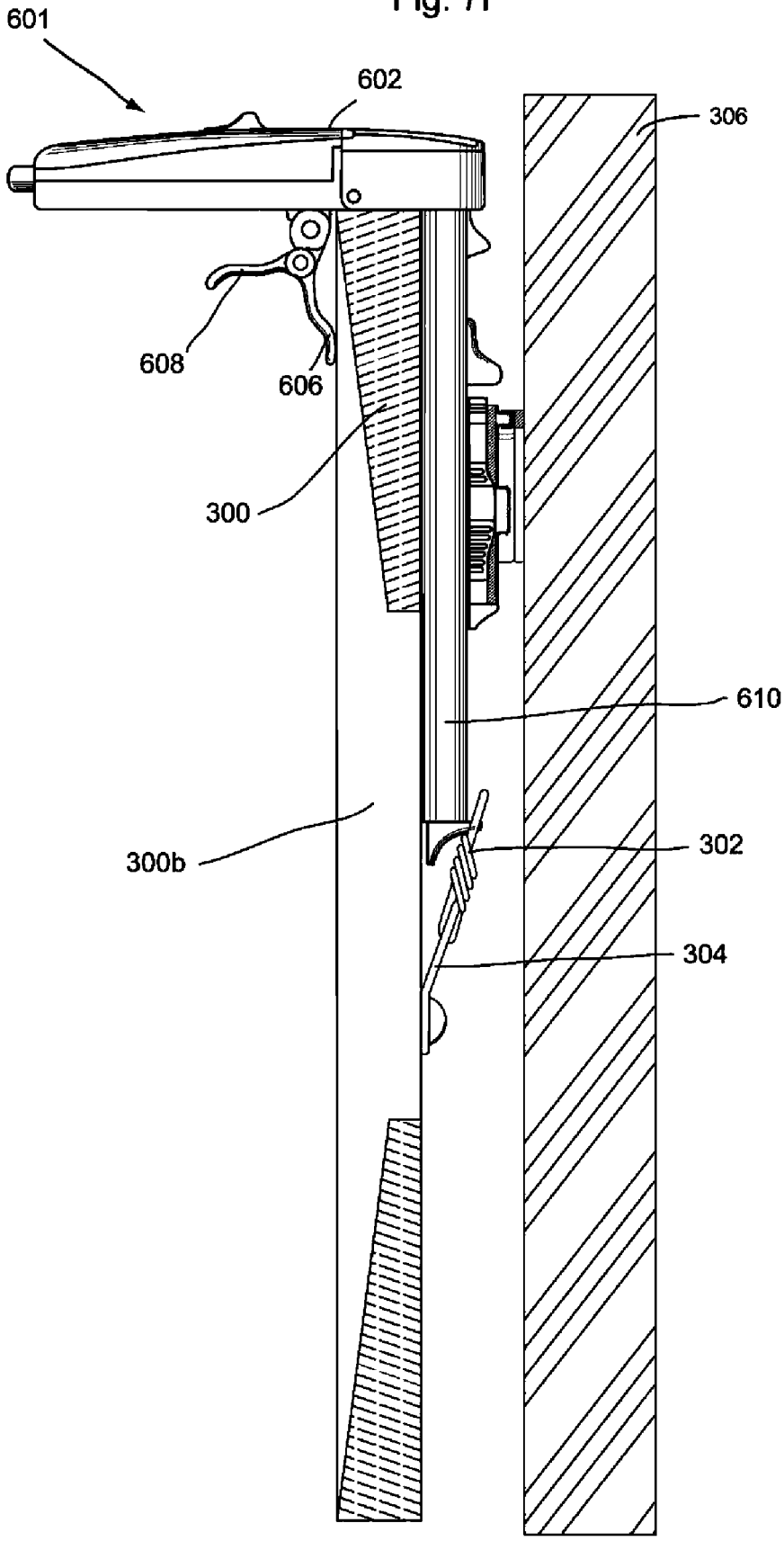
FIG. 7F shows a side view of the apparatus of FIG. 6A in a sixth state, along with the frame of FIGS. 5A-5B, a portion of the apparatus of FIG. 2B, and a wall.

FIG. 7F shows a side view of the apparatus 601 in a sixth state, along with the frame 300, and a portion of the apparatus 10. In the sixth state the apparatus 601 has been attached by a portion of the apparatus 10 to wall 306. Generally, waxpaper 14 would be removed from apparatus 10, and then portion 16 and upper cap 18 shown by FIGS. 1-2C, would be attached to the wall 306.

Figure 7G:
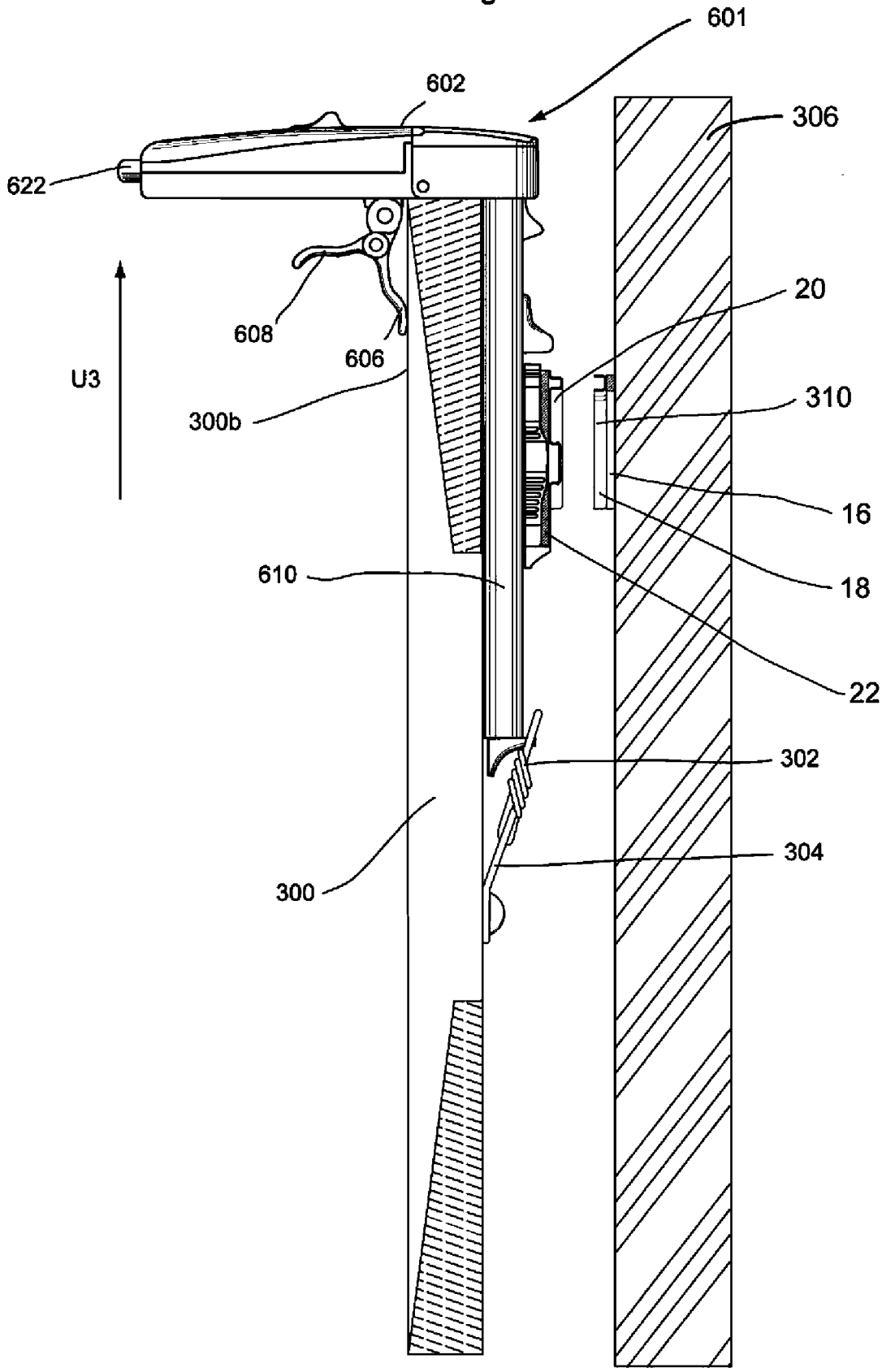
FIG. 7G shows a side view of the apparatus of FIG. 6A in a seventh state, along with the frame of FIGS. 5A-5B, a portion of the apparatus of FIG. 2B, and a wall.

FIG. 7G shows a side view of the apparatus 601 in a seventh state, along with the frame 300 and the 306. The portion 16 along with the upper cap 18 are detached from lower cap 20, and the portion 16 and upper cap 18 are shown in FIG. 7G adhered on the wall 306). The apparatus 601 is now removed from the frame 300 in the direction U3 by pushing the button 622.

Figure 8:
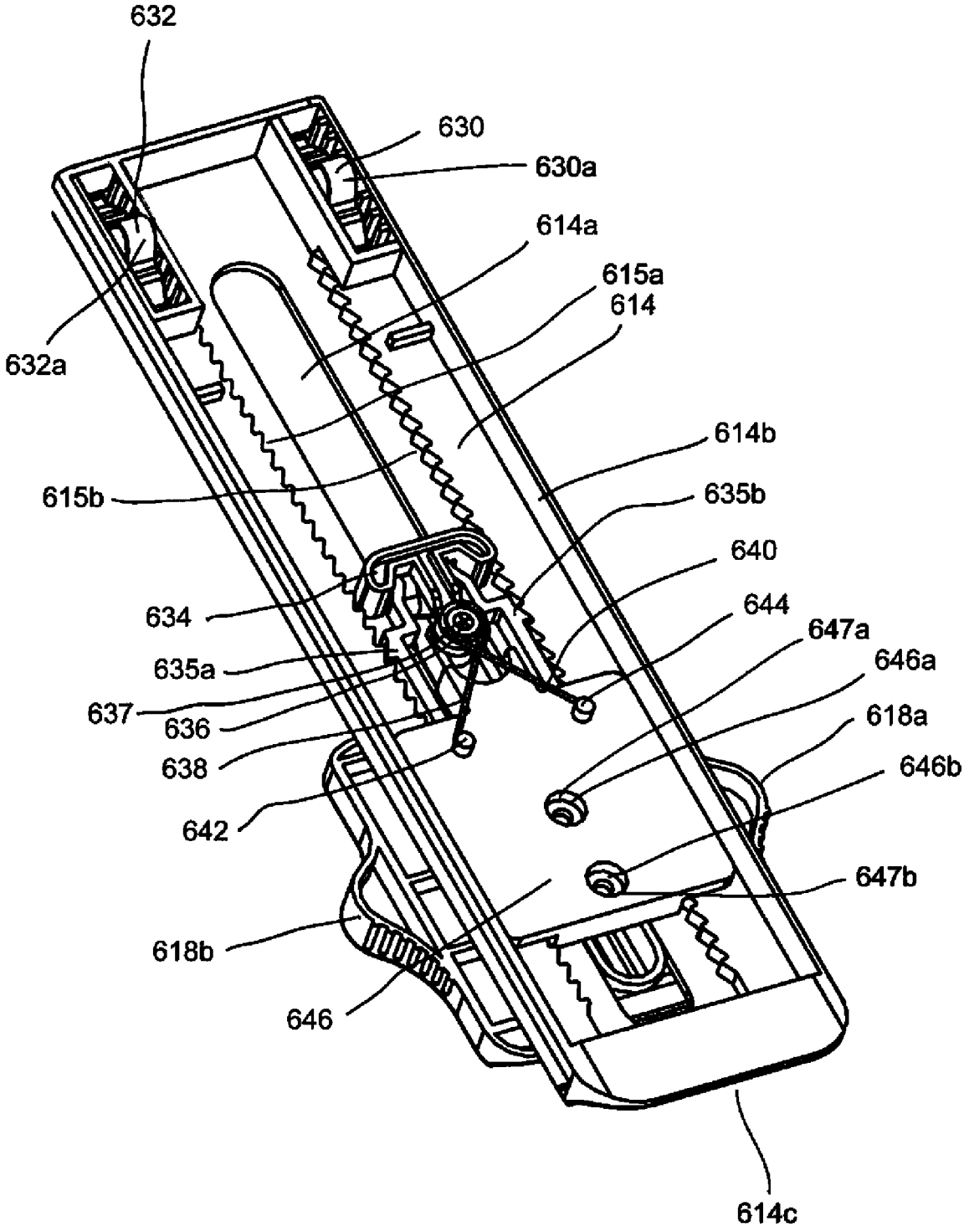
FIG. 8 shows a perspective view of a back of an extension portion of the apparatus of FIG. 6A.

FIG. 8 shows a perspective view of a back of the extension arm 614 of the apparatus 601 and some of the components of the extension portion 610. FIG. 8 shows springs 630 and 632. FIG. 8 also shows a base release controller 634, control arms or devices 635*a* and 635*b*. The control arms or devices 635*a* and 635*b* are typically connected with each other in one piece. FIG. 8 also shows a base back cover 646, and a protrusion 636, which is used to hold control spring arms 638 and 640. FIG. 8 also shows a slot 637 for the screws 636 to fasten the spring arms 638 and 640, and, control springs arms 638 and 640 attached to control spring stoppers 642 and 644, respectively. The control spring stoppers 642 and 644 are connected to the base back cover 646. The base back cover 646 has openings 646*a* and 646*b*.

Figure 11:
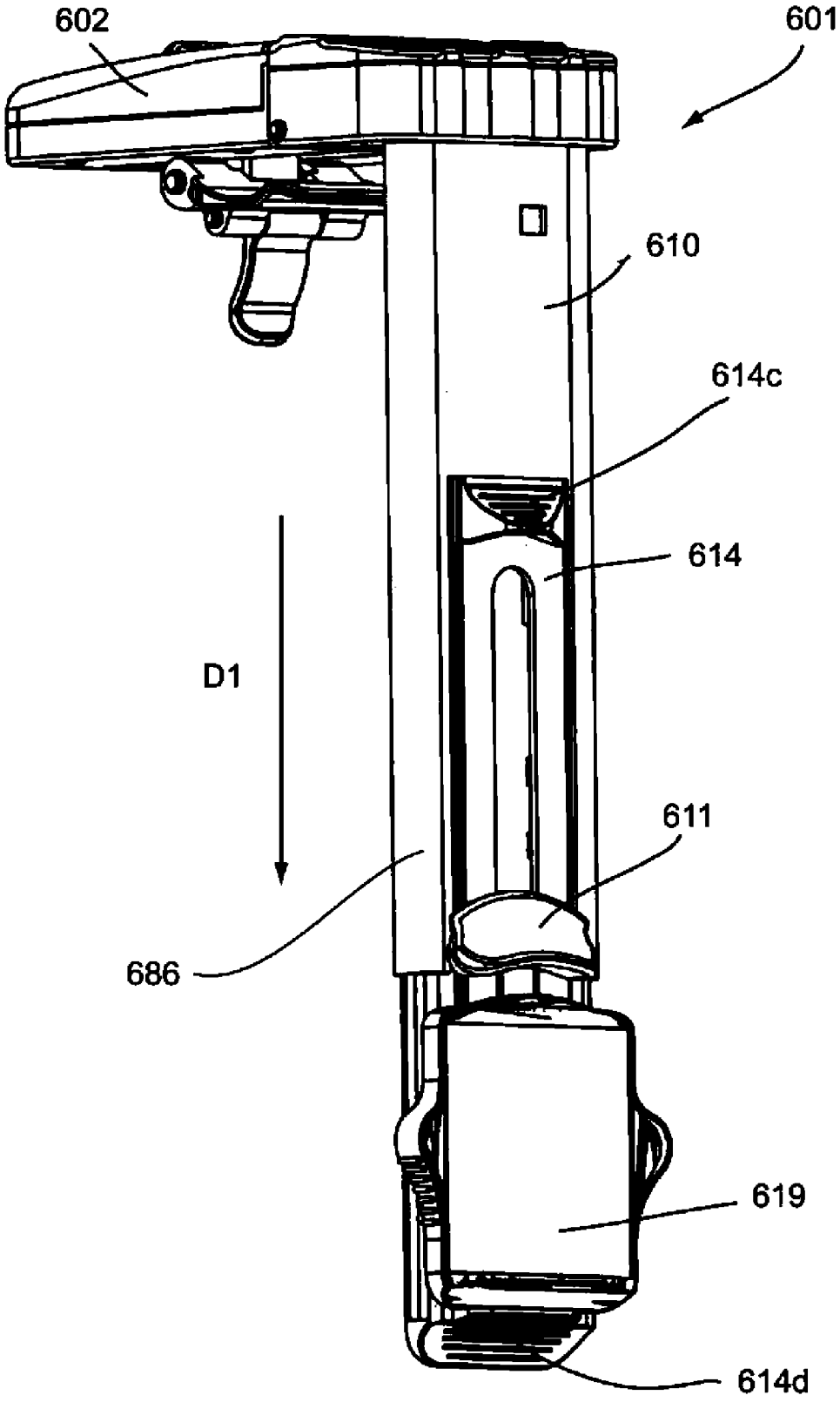
FIG. 11 shows a perspective view of the apparatus of FIG. 6A with the extension portion expanded.

Springs 630 and 632 have protrusions 630*a* and 632*a*, respectively, which go into the openings or cutouts 631*a* and 631*b*, respectively of the insert 686 shown in FIG. 12, so as to control the traveling distance of the extension arm 614 within the extension portion 610. As the extension arm 614 is extended in the direction D1 for larger frames, as shown in FIG. 11, the protrusions 630*a* and 632*a* of the springs 630 and 632 fall into the lower cutouts or openings 611*a* and 611*c* shown in FIG. 12. The extension arm 614 can hardly be pushed upwards in the direction U1 shown in FIG. 6A easily without applying extra force on the bottom 614*c* of the extension arm 614 in the direction U1, as shown in FIG. 6A. This is mainly for the action shown in FIG. 7D, i.e. the slide up force in the direction U1 will typically bring the base 618 and the apparatus 10 upwards in the direction U1 without causing the extension arm 614 to go upwards in the direction U1 at the same time.

The extension portion 610 also includes a base release controller 634, shown in FIG. 8, which connects with the base release 611, shown in FIG. 6A. As the base release 611 and the base release controller 634 slide down in a direction D1, shown in FIG. 6A, opposite to U1, in FIG. 7D, causing devices 635*a* and 635*b*, shown in FIG. 8, to contract, anti-locking gears on the devices 635*a* and 635*b* disengage with gears 615*a* and 615*b*, respectively, on the extension arm 614, causing down sliding movement, in the direction opposite U1, of the base 618, shown in FIG. 6A, and the base back plate 646, shown in FIG. 8. When the base release 611 is released, the nature of the control spring arms 638 and 640 pushes the base 636, base release controller 634 and base release 611 upwards, in the direction U1, causing the expansion of devices 635*a* and 635*b*, eventually engaging the gears 615*a* and 615*b* on the extension arm 614. The base 636 is used to fasten the control springs 638 and 640. The base 636 is part of the base release controller 634. The apparatus 601 includes control springs 638 and 640, which may be integrated together as one piece, control spring stoppers 642 and 644, and base back cover 646. The base back cover 646 connects with the base 618 at the other side through screws 646*a* and 646*b*, inserted through openings 647*a* and 647*b*, respectively. The extension arm 614 is "sandwiched" in between the base back cover 646 and the base 618.

Figure 9:
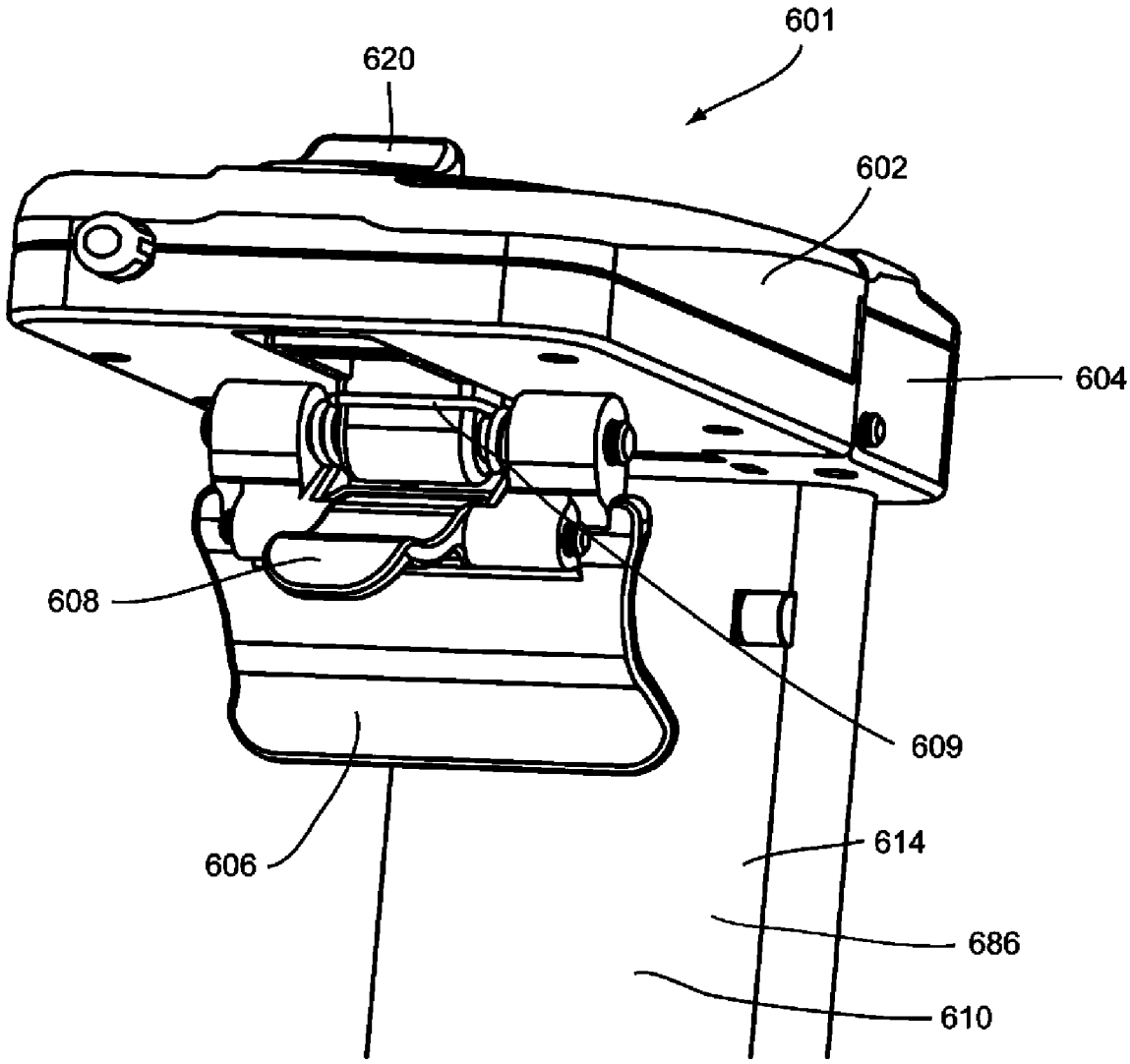
FIG. 9 shows a perspective view of a portion of the apparatus of FIG. 6A, with a frame clamp and handle in a partially open state.

FIG. 9 shows a perspective view of a portion of the apparatus 601, with a frame clamp 606 and handle 608 in a partially open state. FIG. 9 also shows a spring 609 which causes frame clamp 606 to spring back into the position shown in FIG. 7C.

FIG. 10 shows a perspective view of the apparatus 601 with the main body 602 folded downwards so that it lies substantially parallel to the extension portion 610 and extension arm 614.

FIG. 11 shows a perspective view of the apparatus 601 with extension arm 614 embedded inside extension portion 610 shown pulled downwards in the direction D1, from the position in FIG. 10.

FIG. 12 shows a perspective view of an extension portion 610 of the apparatus 601 of FIG. 6A. The extension arm 614 can be pushed downwards effectively (within) the extension portion 610 in order to accomodate bigger picture frames.

Figure 13:
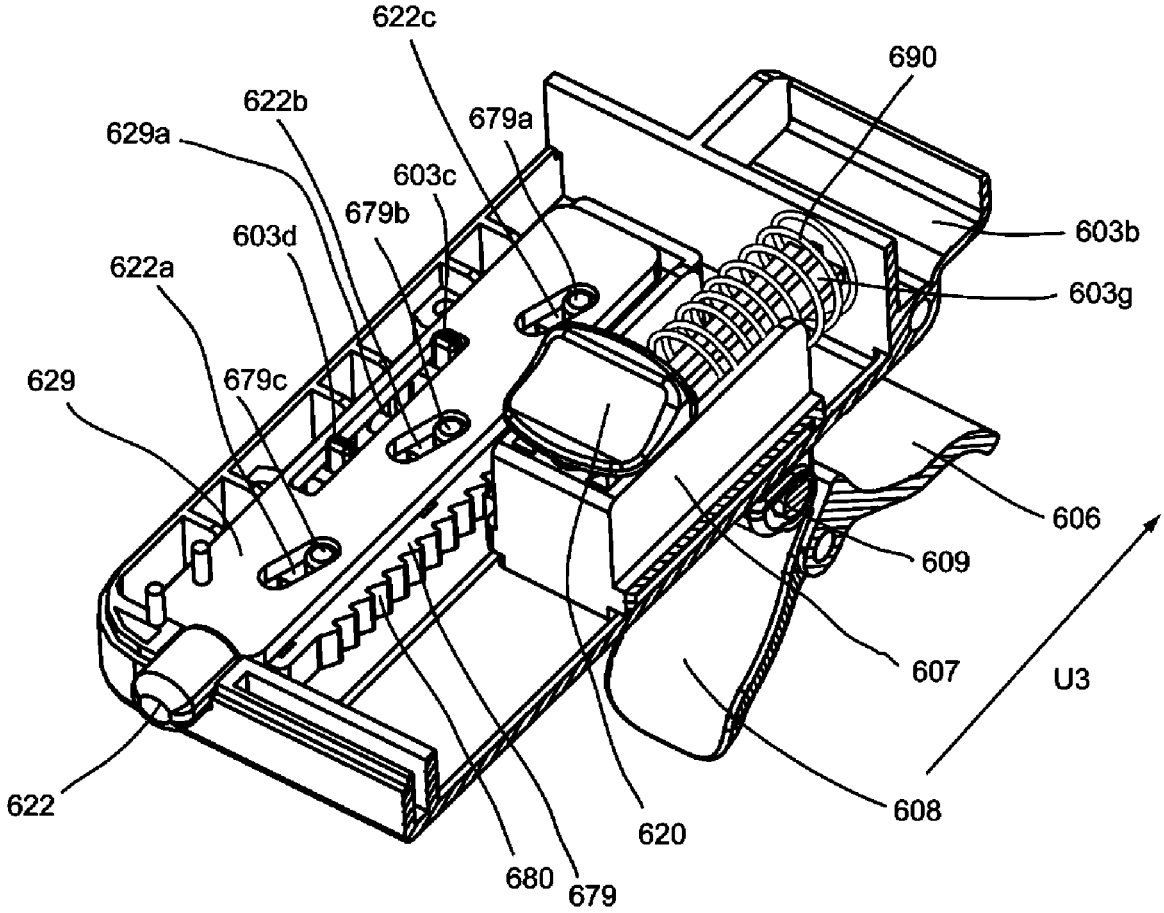
FIG. 13 shows a perspective view of a cutout of part of the bottom half of a housing of a main body of the apparatus of FIG. 6A with a gear engaged.
Figure 14:
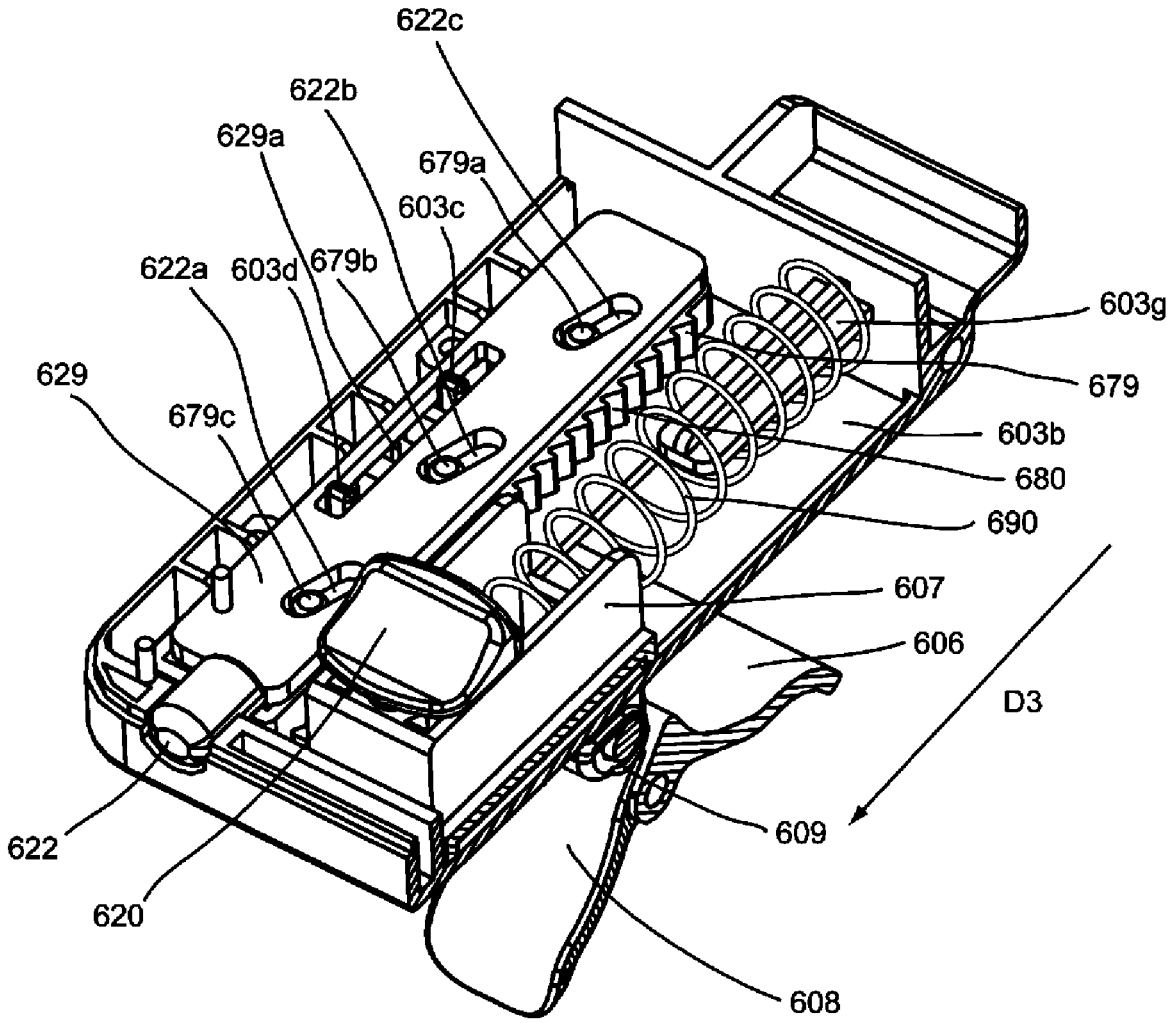
FIG. 14 shows a perspective view of a cutout of part of the bottom half of a housing of a main body of the apparatus of FIG. 6A with a gear disengaged.
Figure 15:
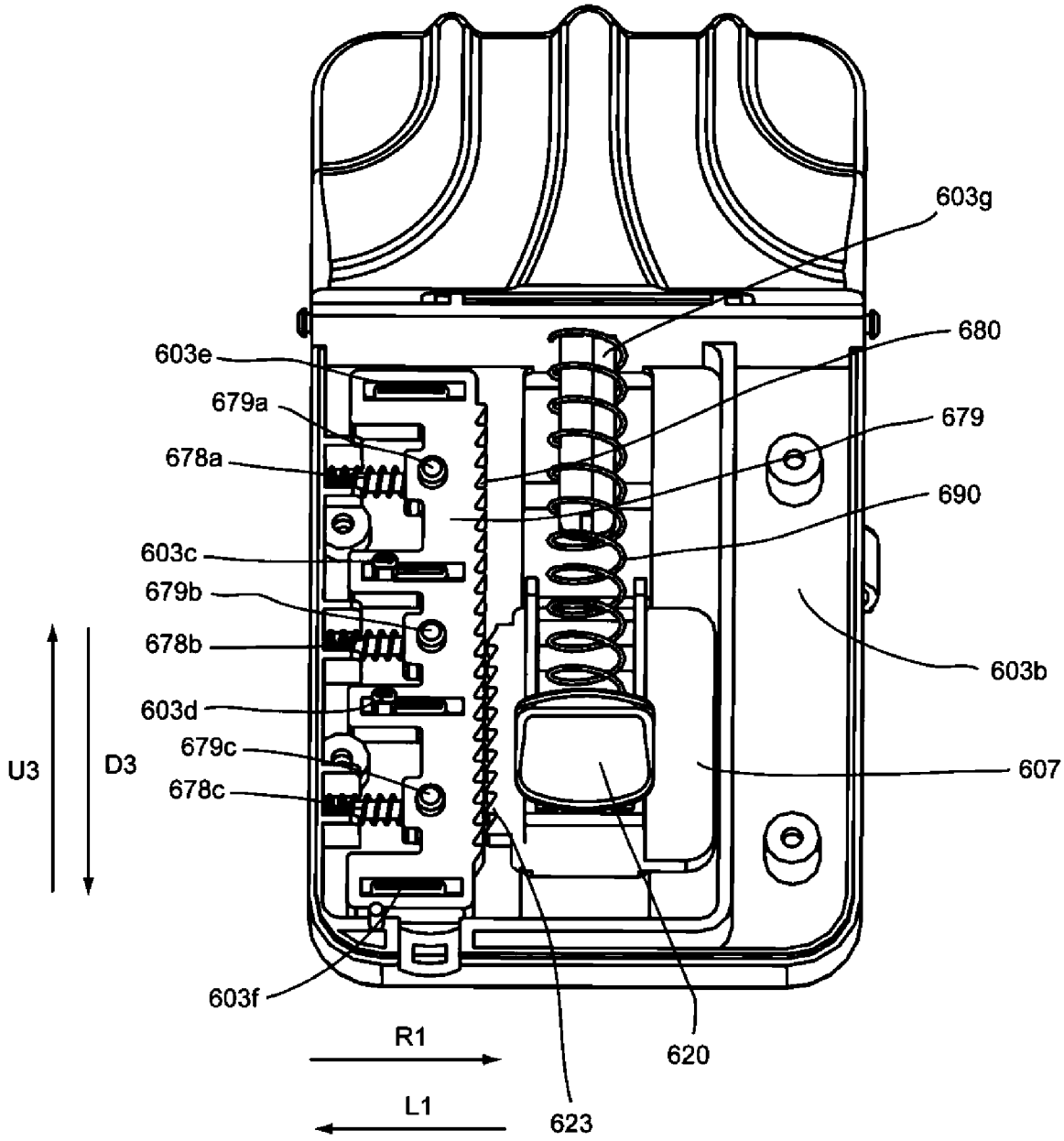
FIG. 15 shows a perspective view of the bottom half of the housing of the main body of the apparatus of FIG. 6A, with a plate and button removed.

FIG. 13 shows a perspective view of a cutout of the bottom half 603*b* of the housing 603 of the main body 602 of the apparatus 601 of FIG. 6A with a gear 680 engaged with gear 623 shown in FIG. 15. The gear 680 engages with gear 623 as button 620 is pushed upwards in the direction U3 in FIG. 13. The gear 680 disengages with the gear 623 as the button 622 is pressed. FIG. 14 shows the gear 680 disengaged from the gear 623 on the base 607 and the button 620 after it has moved back in the direction D3. When button 620 is pushed upwards in the direction U3 shown in FIG. 13, the gear 680 is engaged with the gear 623 shown in FIG. 15 on the base or extension base 607 shown in FIGS. 15 and 6B, causing button 620, clamp 606, and handle 608 to be locked. A spring 690 is shown in FIG. 13 and has been compressed by the button 620.

FIG. 13 also shows openings 622*a-c*, protrusions 679*a-c* which protrude through openings 622*a-c*, protrusions 603*c-d*, which protrude through slot 629*a* in a plate 629. The plate 629 is connected to button 622. The plate 629 sits on top of the gear base 679 shown in FIG. 15.

FIG. 14 shows a perspective view of a cutout of the bottom half 603*b* of the housing 603 of the main body 602 of the apparatus 601 of FIG. 6A with the gear 680 disengaged. When the gear 680 is disengaged the spring 690 causes the button 620 to be biased or forced into an open state as shown in FIG. 14.

FIG. 15 shows a perspective view of the bottom half 603*b* of the housing 603 of the main body 602 of the apparatus 601 of FIG. 6A, with the plate 629 and button 622 removed. FIG. 15 shows protrusions 603*e-f*, springs 678*a-c*, protrusions 679*a-c*, gear 623, gear 680, gear base 679, spring 690, button 620, and base 607. Gear base 679 is capable of horizontal movement only in the directions R1 and L1 shown in FIG. 15. Springs 678*a-c* are used to push the gear base 679 to the right. Gear base 679 moves to the right in the direction R1 in FIG. 15, or to the left in the direction L1 in FIG. 15, but does not move up or down in the directions U3 or D3 shown in FIG. 15. Protrusions 603*c-d* limit horizontal movement (in the directions R1 and L1 in FIG. 15) of the gear base 679 and limit up and down movement in the directions U3 and D3, respectively, of push button 622. Protrusions 603*e-f* limit horizontal movement of the gear base 679. FIG. 15 also shows protrusion or post 603*g* around which spring 690 winds.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method of hanging a picture frame comprising using a first apparatus and a second apparatus to hang a picture frame up, the first apparatus comprising a main body portion;

a first portion connected to the main body portion; and an extension portion connected to the first portion;

wherein the extension portion is comprised of an extension arm and a first base which is attached to the extension arm by an attachment means; and wherein the first base is attached to the extension arm by the attachment means in a manner which allows the first base to slide up and down the extension arm, while attached to the extension arm; further comprising a first base release which releases the first base and allows the first base to slide up and down the extension arm;

the second apparatus comprising:

a J-shaped hanger including a hook and a second base, the hook connected to the second base, the second base forming a substantially flat vertical portion of the J-shape, the hook forming the hook portion of the J-shape;

a first device, wherein the first device has a front with a first temporary adhesive and a back with a second temporary adhesive;

wherein the method further comprises:

adhering the first temporary adhesive and the front of the first device to the first base of the first apparatus to thereby adhere the J-shaped hanger to the first base of the first apparatus;

securing a first end of a cord to a back of a picture frame and a second opposing end of the cord to the hook of the J-shaped hanger;

sliding the first base of the first apparatus and the adhered J-shaped hanger upwards, so that the first base remains attached to the extension arm by the attachment means, but is moved with respect to the extension arm, towards the first portion until the cord is taut;

detaching the J-shaped hanger from the first base;

adhering the second temporary adhesive and the back of the first device to a wall, such that the second apparatus is attached to the wall, without the J-shaped hanger;

while a first part of the second apparatus is attached to the wall, without the J-shaped hanger, using the first part of the second apparatus without the J-shaped hanger, as a guide to attach the J-shaped hanger to the wall; and hanging a picture frame on the J-shaped hanger.

2. The method of claim 1 wherein the first portion is connected to the main body portion so that the main body portion pivots with respect to the first portion.

3. The method of claim 1 wherein the apparatus further includes a clamp connected to the main body portion so that the clamp can pivot with respect to the main body portion; and a handle connected to the clamp so that the handle can pivot with respect to the clamp.

4. The method of claim 3 wherein the main body portion is comprised of a top surface and a bottom surface;

and wherein the apparatus is further comprised of a button on the top surface of the main body portion, which can be slid in order to slide the clamp and the handle.

5. The method of claim 1 wherein the extension arm can be moved outwards in order to lengthen the extension portion.

* * * * *